US007025154B2

(12) United States Patent
Zupanick

(10) Patent No.: US 7,025,154 B2
(45) **Date of Patent: *Apr. 11, 2006**

(54) METHOD AND SYSTEM FOR CIRCULATING FLUID IN A WELL SYSTEM

(75) Inventor: Joseph A. Zupanick, Pineville, WV (US)

(73) Assignee: CDX Gas, LLC, Dallas, TX (US)

( * ) Notice: Subject to any disclaimer, the term of this patent is extended or adjusted under 35 U.S.C. 154(b) by 55 days.

This patent is subject to a terminal disclaimer.

(21) Appl. No.: 10/323,192

(22) Filed: Dec. 18, 2002

(65) Prior Publication Data

US 2004/0055787 A1 Mar. 25, 2004

Related U.S. Application Data

(63) Continuation-in-part of application No. 09/788,897, filed on Feb. 20, 2001, now Pat. No. 6,732,792, which is a division of application No. 09/444,029, filed on Nov. 19, 1999, now Pat. No. 6,357,523, which is a continuation-in-part of application No. 09/197,687, filed on Nov. 20, 1998, now Pat. No. 6,280,000.

(51) Int. Cl.
*E21B 21/14* (2006.01)

(52) U.S. Cl. ..... 175/69; 175/205; 175/213; 175/217

(58) Field of Classification Search ..... 175/69, 175/71, 205, 217, 213
See application file for complete search history.

(56) References Cited

U.S. PATENT DOCUMENTS

| | | | |
|---|---|---|---|
| 54,144 | A | 4/1866 | Hamar |
| 274,740 | A | 3/1883 | Douglass |
| 526,708 | A | 10/1894 | Horton |
| 639,036 | A | 12/1899 | Heald |
| 1,189,560 | A | 7/1916 | Gondos |
| 1,285,347 | A | 11/1918 | Otto |
| 1,467,480 | A | 9/1923 | Hogue |

(Continued)

FOREIGN PATENT DOCUMENTS

| | | | |
|---|---|---|---|
| AU | 85/49964 | A | 11/1986 |
| CA | 2210866 | | 1/1998 |
| CA | 2 278 735 | | 1/1998 |
| DE | 653 741 | | 1/1986 |
| DE | 197 25 996 | A1 | 1/1998 |

(Continued)

OTHER PUBLICATIONS

Notification of Transmittal of the International Search Report or the Declaration (PCT Rule 44.1) mailed Dec. 19, 2003 (6 pages) re International Application No. PCT/US 03/28137.

(Continued)

*Primary Examiner*—John Kreck
(74) *Attorney, Agent, or Firm*—Fish & Richardson P.C.

(57) ABSTRACT

A method for circulating drilling fluid in a well system includes drilling a substantially vertical well bore from a surface to a subterranean zone and drilling an articulated well bore from the surface to the subterranean zone. The articulated well bore is horizontally offset from the substantially vertical well bore at the surface and intersects the substantially vertical well bore at a junction proximate the subterranean zone. The method includes drilling a drainage bore from the junction into the subterranean zone and pumping a drilling fluid through the drill string when drilling the drainage bore. The method also includes providing fluid down the substantially vertical well bore through a tubing. A fluid mixture returns up the substantially vertical well bore outside of the tubing. The fluid mixture comprises the drilling fluid after the drilling fluid exits the drill string.

63 Claims, 4 Drawing Sheets

U.S. PATENT DOCUMENTS

| | | | | | |
|---|---|---|---|---|---|
| 1,485,615 | A | | 3/1924 | Jones | |
| 1,488,106 | A | | 3/1924 | Fitzpatrick | |
| 1,520,737 | A | | 12/1924 | Wright | |
| 1,674,392 | A | | 6/1928 | Flansburg | |
| 1,777,961 | A | | 10/1930 | Capeliuschnicoff | |
| 2,018,285 | A | | 10/1935 | Schweitzer et al. | 166/21 |
| 2,069,482 | A | | 2/1937 | Seay | 255/76 |
| 2,150,228 | A | | 3/1939 | Lamb | 166/10 |
| 2,169,718 | A | | 8/1939 | Boll et al. | 255/24 |
| 2,335,085 | A | | 11/1943 | Roberts | 251/197 |
| 2,450,223 | A | | 9/1948 | Barbour | 255/76 |
| 2,490,350 | A | | 12/1949 | Grable | 166/4 |
| 2,679,903 | A | | 6/1954 | McGowen, Jr. et al. | 166/1 |
| 2,726,063 | A | | 12/1955 | Ragland et al. | 255/1.8 |
| 2,726,847 | A | | 12/1955 | McCune et al. | 255/1.6 |
| 2,783,018 | A | | 2/1957 | Lytle | 251/25 |
| 2,797,893 | A | | 7/1957 | McCune et al. | |
| 2,847,189 | A | | 8/1958 | Shook | 255/76 |
| 2,911,008 | A | | 11/1959 | Du Bois | 137/625.31 |
| 2,980,142 | A | | 4/1961 | Turak | 137/637.3 |
| 3,208,537 | A | | 9/1965 | Scarborough | 175/53 |
| 3,347,595 | A | | 10/1967 | Dahms et al. | 299/4 |
| 3,385,382 | A | | 5/1968 | Canalizo et al. | |
| 3,443,648 | A | | 5/1969 | Howard | 175/103 |
| 3,473,571 | A | | 10/1969 | Dugay | 137/625.4 |
| 3,503,377 | A | | 3/1970 | Beatenbough et al. | 123/117 |
| 3,528,516 | A | | 9/1970 | Brown | 175/267 |
| 3,530,675 | A | | 9/1970 | Turzillo | 61/35 |
| 3,582,138 | A | | 6/1971 | Loofbourow et al. | |
| 3,587,743 | A | | 6/1971 | Howard | |
| 3,684,041 | A | | 8/1972 | Kammerer, Jr. et al. | 175/267 |
| 3,692,041 | A | | 9/1972 | Bondi | 137/238 |
| 3,744,565 | A | | 7/1973 | Brown | |
| 3,757,876 | A | | 9/1973 | Pereau | 175/267 |
| 3,757,877 | A | | 9/1973 | Leathers | 175/269 |
| 3,800,830 | A | | 4/1974 | Etter | 137/625.41 |
| 3,809,519 | A | | 5/1974 | Garner | 425/245 |
| 3,825,081 | A | | 7/1974 | McMahon | 175/73 |
| 3,828,867 | A | | 8/1974 | Elwood | 175/45 |
| 3,874,413 | A | | 4/1975 | Valdez | 137/625.47 |
| 3,887,008 | A | | 6/1975 | Canfield | 166/267 |
| 3,902,322 | A | | 9/1975 | Watanabe | 61/35 |
| 3,907,045 | A | | 9/1975 | Dahl et al. | 175/45 |
| 3,934,649 | A | | 1/1976 | Pasini, III et al. | 166/254 |
| 3,957,082 | A | | 5/1976 | Fuson et al. | 137/625.41 |
| 3,961,824 | A | | 6/1976 | Van Eek et al. | 299/17 |
| 4,011,890 | A | | 3/1977 | Andersson | 137/625.4 |
| 4,020,901 | A | | 5/1977 | Pisio et al. | |
| 4,022,279 | A | | 5/1977 | Driver | 166/271 |
| 4,030,310 | A | | 6/1977 | Schirtzinger | |
| 4,037,658 | A | | 7/1977 | Anderson | 166/272 |
| 4,060,130 | A | | 11/1977 | Hart | |
| 4,073,351 | A | | 2/1978 | Baum | 175/14 |
| 4,089,374 | A | | 5/1978 | Terry | 166/259 |
| 4,116,012 | A | | 9/1978 | Abe et al. | 405/238 |
| 4,134,463 | A | * | 1/1979 | Allen | 175/53 |
| 4,136,996 | A | | 1/1979 | Burns | |
| 4,151,880 | A | | 5/1979 | Vann | |
| 4,156,437 | A | | 5/1979 | Chivens et al. | 137/554 |
| 4,169,510 | A | | 10/1979 | Meigs | 175/65 |
| 4,182,423 | A | | 1/1980 | Ziebarth et al. | |
| 4,189,184 | A | | 2/1980 | Green | 299/8 |
| 4,220,203 | A | | 9/1980 | Steeman | 166/271 |
| 4,221,433 | A | | 9/1980 | Jacoby | 299/4 |
| 4,222,611 | A | | 9/1980 | Larson et al. | |
| 4,224,989 | A | | 9/1980 | Blount | 166/250 |
| 4,226,475 | A | | 10/1980 | Frosch et al. | |
| 4,257,650 | A | | 3/1981 | Allen | 299/2 |
| 4,278,137 | A | | 7/1981 | Van Eek | 175/267 |
| 4,283,088 | A | | 8/1981 | Tabakov et al. | 299/2 |
| 4,296,785 | A | | 10/1981 | Vitello et al. | 141/105 |
| 4,299,295 | A | | 11/1981 | Gossard | 175/45 |
| 4,303,127 | A | | 12/1981 | Freel et al. | 166/266 |
| 4,305,464 | A | | 12/1981 | Masszi | 166/370 |
| 4,312,377 | A | | 1/1982 | Knecht | 137/625.19 |
| 4,317,492 | A | | 3/1982 | Summers et al. | 175/79 |
| 4,328,577 | A | | 5/1982 | Abbott et al. | 370/84 |
| 4,333,539 | A | | 6/1982 | Lyons et al. | 175/61 |
| 4,366,988 | A | | 1/1983 | Bodine | 299/14 |
| 4,372,398 | A | | 2/1983 | Kuckes | 175/45 |
| 4,386,665 | A | | 6/1983 | Dellinger | 175/61 |
| 4,390,067 | A | | 6/1983 | Willman | 166/245 |
| 4,396,076 | A | | 8/1983 | Inoue | 175/265 |
| 4,397,360 | A | | 8/1983 | Schmidt | 175/61 |
| 4,401,171 | A | | 8/1983 | Fuchs | 175/267 |
| 4,407,376 | A | | 10/1983 | Inoue | 175/267 |
| 4,415,205 | A | | 11/1983 | Rehm et al. | |
| 4,417,829 | A | | 11/1983 | Berezoutzky | |
| 4,422,505 | A | | 12/1983 | Collins | |
| 4,437,706 | A | | 3/1984 | Johnson | 299/7 |
| 4,442,896 | A | | 4/1984 | Reale et al. | 166/278 |
| 4,463,988 | A | | 8/1984 | Bouck et al. | |
| 4,494,616 | A | | 1/1985 | McKee | 175/67 |
| 4,502,733 | A | | 3/1985 | Grubb | |
| 4,512,422 | A | | 4/1985 | Knisley | 175/99 |
| 4,519,463 | A | | 5/1985 | Schuh | 175/61 |
| 4,527,639 | A | | 7/1985 | Dickinson, III et al. | 175/61 |
| 4,532,986 | A | | 8/1985 | Mims et al. | 166/50 |
| 4,533,182 | A | | 8/1985 | Richards | |
| 4,536,035 | A | * | 8/1985 | Huffman et al. | 299/17 |
| 4,544,037 | A | | 10/1985 | Terry | 166/369 |
| 4,558,744 | A | | 12/1985 | Gibb | 166/335 |
| 4,565,252 | A | | 1/1986 | Campbell et al. | 175/269 |
| 4,573,541 | A | | 3/1986 | Josse et al. | 175/78 |
| 4,599,172 | A | | 7/1986 | Gardes | 210/314 |
| 4,600,061 | A | | 7/1986 | Richards | 175/62 |
| 4,603,592 | A | | 8/1986 | Siebold et al. | |
| 4,605,076 | A | | 8/1986 | Goodhart | 175/61 |
| 4,611,855 | A | | 9/1986 | Richards | 299/2 |
| 4,618,009 | A | | 10/1986 | Carter et al. | 175/267 |
| 4,638,949 | A | | 1/1987 | Mancel | 239/307 |
| 4,646,836 | A | | 3/1987 | Goodhart | 166/303 |
| 4,651,836 | A | | 3/1987 | Richards | |
| 4,674,579 | A | | 6/1987 | Geller et al. | 175/45 |
| 4,702,314 | A | | 10/1987 | Huang et al. | 166/245 |
| 4,705,431 | A | | 11/1987 | Gadelle et al. | 405/267 |
| 4,715,440 | A | | 12/1987 | Boxell et al. | 166/100 |
| 4,753,485 | A | | 6/1988 | Goodhart | |
| 4,754,819 | A | | 7/1988 | Dellinger | 175/61 |
| 4,756,367 | A | | 7/1988 | Puri et al. | 166/263 |
| 4,763,734 | A | | 8/1988 | Dickinson et al. | 175/61 |
| 4,773,488 | A | | 9/1988 | Bell et al. | 175/61 |
| 4,776,638 | A | | 10/1988 | Hahn | |
| 4,830,105 | A | | 5/1989 | Petermann | 166/241 |
| 4,832,122 | A | | 5/1989 | Corey et al. | |
| 4,836,611 | A | | 6/1989 | El-Saie | 299/7 |
| 4,842,081 | A | | 6/1989 | Parant | 175/23 |
| 4,844,182 | A | | 7/1989 | Tolle | 175/215 |
| 4,852,666 | A | | 8/1989 | Brunet et al. | 175/61 |
| 4,883,122 | A | | 11/1989 | Puri et al. | 166/248 |
| 4,889,186 | A | | 12/1989 | Hanson et al. | |
| 4,978,172 | A | | 12/1990 | Schwoebel et al. | 299/12 |
| 5,016,710 | A | | 5/1991 | Renard et al. | 166/245 |
| 5,035,605 | A | | 7/1991 | Dinerman et al. | 481/18 |
| 5,036,921 | A | | 8/1991 | Pittard et al. | 166/298 |
| 5,074,360 | A | | 12/1991 | Guinn | 166/281 |
| 5,074,365 | A | | 12/1991 | Kuckes | 175/40 |
| 5,074,366 | A | | 12/1991 | Karlsson et al. | 175/76 |
| 5,082,054 | A | | 1/1992 | Kiamanesh | 166/248 |
| 5,111,893 | A | | 5/1992 | Kvello-Aune | 175/258 |
| 5,121,244 | A | | 6/1992 | Takasaki | |

5,127,457 A 7/1992 Stewart et al.
5,135,058 A 8/1992 Millgard et al. ..... 175/71
5,148,875 A 9/1992 Karlsson et al. ..... 175/62
5,148,877 A 9/1992 MacGregor
5,165,491 A 11/1992 Wilson ..... 175/62
5,168,942 A 12/1992 Wydrinski ..... 175/50
5,174,374 A 12/1992 Hailey ..... 166/55.8
5,193,620 A 3/1993 Braddick ..... 166/382
5,194,859 A 3/1993 Warren ..... 340/853.4
5,194,977 A 3/1993 Nishio
5,197,553 A 3/1993 Leturno ..... 175/57
5,197,783 A 3/1993 Theimer et al. ..... 299/17
5,199,496 A 4/1993 Redus et al. ..... 166/366
5,201,817 A 4/1993 Hailey ..... 175/269
5,217,076 A 6/1993 Masek ..... 166/303
5,226,495 A 7/1993 Jennings, Jr. ..... 166/278
5,240,350 A 8/1993 Yamaguchi et al. ..... 405/143
5,242,017 A 9/1993 Hailey ..... 166/55.8
5,242,025 A 9/1993 Neill et al. ..... 175/26
5,246,273 A 9/1993 Rosar ..... 299/4
5,255,741 A 10/1993 Alexander ..... 166/278
5,271,472 A 12/1993 Leturno ..... 175/107
5,287,926 A 2/1994 Grupping
5,301,760 A 4/1994 Graham ..... 175/61
5,355,967 A 10/1994 Mueller et al.
5,363,927 A 11/1994 Frank ..... 175/67
5,385,205 A 1/1995 Hailey ..... 166/55.8
5,394,950 A 3/1995 Gardes ..... 175/45
5,402,851 A 4/1995 Baiton ..... 166/369
5,411,082 A 5/1995 Kennedy ..... 166/181
5,411,085 A 5/1995 Moore et al. ..... 166/242
5,411,088 A 5/1995 LeBlanc et al. ..... 166/265
5,411,104 A 5/1995 Stanley ..... 175/65
5,411,105 A 5/1995 Gray ..... 175/69
5,431,220 A 7/1995 Lennon et al. ..... 166/55.7
5,431,482 A 7/1995 Russo
5,435,400 A 7/1995 Smith ..... 175/61
5,447,416 A 9/1995 Wittrisch ..... 417/442
5,450,902 A 9/1995 Matthews ..... 166/268
5,454,419 A 10/1995 Vloedman ..... 166/277
5,458,209 A 10/1995 Hayes et al. ..... 175/61
5,462,116 A 10/1995 Carroll ..... 166/249
5,462,120 A 10/1995 Gondouin ..... 166/380
5,469,155 A 11/1995 Archambeault et al. . 340/853.4
5,477,923 A 12/1995 Jordan, Jr. et al. ..... 66/313
5,485,089 A 1/1996 Kuckes ..... 324/346
5,494,121 A 2/1996 Nackerud ..... 175/263
5,499,687 A 3/1996 Lee ..... 175/317
5,501,273 A 3/1996 Puri ..... 166/252.5
5,501,279 A 3/1996 Garg et al. ..... 166/372
5,584,605 A 12/1996 Beard et al. ..... 405/128
5,613,242 A 3/1997 Oddo ..... 588/17
5,615,739 A 4/1997 Dallas ..... 166/306
5,653,286 A 8/1997 McCoy et al. ..... 166/105.5
5,659,347 A 8/1997 Taylor
5,669,444 A 9/1997 Riese et al. ..... 166/263
5,676,207 A 10/1997 Simon et al.
5,680,901 A 10/1997 Gardes ..... 166/313
5,690,390 A 11/1997 Bithell ..... 299/4
5,697,445 A 12/1997 Graham
5,706,871 A 1/1998 Anderson et al. ..... 141/59
5,720,356 A 2/1998 Gardes ..... 175/62
5,727,629 A 3/1998 Blizzard, Jr. et al. ..... 166/298
5,735,350 A 4/1998 Longbottom et al. ..... 166/313
5,771,976 A 6/1998 Talley ..... 166/370
5,775,433 A 7/1998 Hammett et al. ..... 166/98
5,775,443 A 7/1998 Lott
5,785,133 A 7/1998 Murray et al. ..... 175/61
5,832,958 A 11/1998 Cheng ..... 137/625.41
5,852,505 A 12/1998 Li
5,853,054 A 12/1998 McGarian et al. ..... 175/267
5,853,056 A 12/1998 Landers ..... 175/424
5,853,224 A 12/1998 Riese
5,863,283 A 1/1999 Gardes ..... 588/250
5,867,289 A 2/1999 Gerstel et al.
5,868,202 A 2/1999 Hsu ..... 166/256
5,868,210 A 2/1999 Johnson et al. ..... 175/40
5,879,057 A 3/1999 Schwoebel et al. ..... 299/17
5,884,704 A 3/1999 Longbottom et al. ..... 16/313
5,912,754 A 6/1999 Koga et al.
5,914,798 A 6/1999 Liu
5,917,325 A 6/1999 Smith ..... 324/326
5,934,390 A 8/1999 Uthe ..... 175/67
5,938,004 A 8/1999 Roberts et al. ..... 198/812
5,941,308 A 8/1999 Malone et al.
5,957,539 A 9/1999 Durup et al. ..... 299/4
5,971,074 A 10/1999 Longbottom et al. ..... 166/313
6,012,520 A 1/2000 Yu et al. ..... 166/245
6,015,012 A 1/2000 Reddick ..... 166/313
6,019,173 A 2/2000 Saurer et al.
6,024,171 A 2/2000 Montgomery et al. ..... 166/308
6,030,048 A 2/2000 Hsu
6,050,335 A 4/2000 Parsons ..... 166/272.3
6,056,059 A 5/2000 Ohmer ..... 166/313
6,062,306 A 5/2000 Gano et al.
6,065,550 A 5/2000 Gardes ..... 175/62
6,065,551 A 5/2000 Gourley et al.
6,119,771 A 9/2000 Gano et al. ..... 166/50
6,119,776 A 9/2000 Graham et al.
6,135,208 A 10/2000 Gano et al. ..... 166/313
6,179,054 B1 1/2001 Stewart ..... 166/105.5
6,189,616 B1 2/2001 Gano et al.
6,209,636 B1 4/2001 Roberts et al. ..... 166/117.6
6,237,284 B1 5/2001 Erickson
6,244,340 B1 6/2001 McGlothen et al.
6,279,658 B1 8/2001 Donovan et al.
6,280,000 B1 8/2001 Zupanick ..... 299/12
6,349,769 B1 2/2002 Ohmer ..... 166/313
6,357,523 B1 3/2002 Zupanick ..... 166/52
6,357,530 B1 3/2002 Kennedy et al. ..... 166/369
6,425,448 B1 7/2002 Zupanick et al. ..... 175/61
6,439,320 B1 8/2002 Zupanick ..... 175/161
6,450,256 B1 9/2002 Mones ..... 166/250.01
6,454,000 B1 9/2002 Zupanick
6,457,540 B1 10/2002 Gardes
6,497,556 B1 12/2002 Zupanick et al.
6,566,649 B1 5/2003 Mickael ..... 250/269.3
6,571,888 B1 6/2003 Comeau et al. ..... 175/61
6,575,255 B1 6/2003 Rial et al.
6,577,129 B1 6/2003 Thompson et al. ..... 324/338
6,585,061 B1 7/2003 Radzinski et al. ..... 175/45
6,590,202 B1 7/2003 Mickael ..... 250/269.2
6,591,903 B1 7/2003 Ingle et al. ..... 166/50
6,591,922 B1 7/2003 Rial et al.
6,595,301 B1 7/2003 Diamond et al.
6,595,302 B1 7/2003 Diamond et al.
6,604,910 B1 8/2003 Zupanick
6,607,042 B1 8/2003 Hoyer et al. ..... 175/38
6,636,159 B1 10/2003 Winnacker ..... 340/854.3
6,639,210 B1 10/2003 Odom et al. ..... 250/269.6
6,644,422 B1 11/2003 Rial et al.
6,646,441 B1 11/2003 Thompson et al. ..... 324/338
6,653,839 B1 11/2003 Yuratich et al. ..... 324/355
6,679,322 B1 1/2004 Zupanick
6,722,452 B1 4/2004 Rial et al.
2002/0010432 A1 1/2002 Zupanick
2002/0015574 A1 2/2002 Zupanick et al.
2002/0043404 A1 4/2002 Trueman et al.
2002/0050358 A1 5/2002 Algeroy et al. ..... 166/313
2002/0074120 A1 6/2002 Scott ..... 166/313
2002/0074122 A1 6/2002 Kelley et al.
2002/0096336 A1 7/2002 Zupanick et al.

| | | | | |
|---|---|---|---|---|
| 2003/0062198 | A1 | 4/2003 | Gardes | 175/61 |
| 2003/0066686 | A1 | 4/2003 | Conn | 175/57 |
| 2003/0075334 | A1 | 4/2003 | Haugen et al. | 166/313 |
| 2003/0164253 | A1 | 9/2003 | Trueman et al. | |
| 2003/0221836 | A1 | 12/2003 | Gardes | |
| 2004/0011560 | A1 | 1/2004 | Rial et al. | |
| 2004/0033557 | A1 | 2/2004 | Scott et al. | |
| 2004/0045719 | A1 | 3/2004 | Moore et al. | |
| 2004/0060351 | A1 | 4/2004 | Gunter et al. | |
| 2004/0140129 | A1 | 7/2004 | Gardes | |
| 2004/0226719 | A1 | 11/2004 | Morgan et al. | |

FOREIGN PATENT DOCUMENTS

| | | | |
|---|---|---|---|
| EP | 0 819 834 | A1 | 1/1998 |
| EP | 0 875 661 | A1 | 11/1998 |
| EP | 0 952 300 | A1 | 10/1999 |
| EP | 1 316 673 | A2 | 6/2003 |
| FR | 964503 | | 4/1944 |
| GB | 442008 | | 1/1936 |
| GB | 444484 | | 3/1936 |
| GB | 651468 | | 4/1951 |
| GB | 893869 | | 4/1962 |
| GB | 2 255 033 | | 10/1992 |
| GB | 2 297 988 | | 8/1996 |
| GB | 2 347 157 | A | 8/2000 |
| RU | 876968 | | 10/1981 |
| SU | 750108 | | 6/1975 |
| SU | 1448078 | A1 | 3/1987 |
| SU | 1770570 | A1 | 3/1990 |
| WO | 94/21889 | | 9/1994 |
| WO | WO 94/28280 | | 12/1994 |
| WO | WO 97/21900 | | 6/1997 |
| WO | WO 98/35133 | | 8/1998 |
| WO | WO 99/60248 | | 11/1999 |
| WO | 00/31376 | | 6/2000 |
| WO | WO 00/79099 | | 12/2000 |
| WO | WO 01/44620 | | 6/2001 |
| WO | WO 02/18738 | | 3/2002 |
| WO | WO 02/059455 | | 8/2002 |
| WO | WO 02/061238 | | 8/2002 |
| WO | WO 03/102348 | | 12/2003 |
| WO | WO 2004/035984 | A1 | 4/2004 |

OTHER PUBLICATIONS

Notification of Transmittal of the International Search Report or the Declaration (PCT Rule 44.1) mailed Dec. 19, 2003 (6 pages) re International Application No. PCT/US 03/28137.

Notification of Transmittal of the International Search Report or the Declaration (PCT Rule 44.1) mailed Feb. 4, 2004 (8 pages) re International Application No. PCT/US 03/26124.

Smith, Maurice, "*Chasing Unconventional Gas Unconventionally,*" CBM Gas Technology, New Technology Magazine, Oct.–Nov. 2003, pp. 1–4.

Gardes, Robert "*A New Direction in Coalbed Methane and Shale Gas Recovery,*" (to the best of Applicants' recollection, first received at The Canadian Institute Coalbed Methane Symposium conference on Jun. 16–17, 2002), 1 page of conference flyer, 6 pages of document.

Gardes, Robert, "*Under–Balance Multi–Lateral Drilling for Unconventional Gas Recovery,*" (to the best of Applicants' recollection, first received at The Unconventional Gas Revolution conference on Dec. 9, 2003), 4 pages of conference flyer, 33 pages of document.

Boyce, Richard "*High Resolution Selsmic Imaging Programs for Coalbed Methane Development,*" (to the best of Applicants' recollection, first received at The Unconventional Gas Revolution conference on Dec. 10, 2003), 4 pages of conference flyer, 24 pages of document.

Mark Mazzella and David Strickland, "*Well Control Operations on a Multiwell Platform Blowout,*" WorldOil.com—Online Magazine Article, vol. 22, Part I—pp. 1–7, and Part II —pp. 1–13.

Vector Magnetics LLC, Case History, California, May 1999, "*Successful Kill of a Surface Blowout,*"pp. 1–12.

Cudd Pressure Control, Inc, "*Successful Well Control Operations–A Case Study: Surface and Subsurface Well Intervention on a Multi–Well Offshore Platform Blowout and Fire,*" pp. 1–17, http://www.cuddwellcontrol.com/literature/successful/successful_well.htm, 2000.

R. Purl, et al., "*Damage to Coal Permeability During Hydraulic Facturing,*" pp. 109–115 (SPE 21813), 1991.

U.S. Dept. of Energy —Office of Fossil Energy, "*Multi–Seam Well Completion Technology: Implications for Powder River Basin Coalbed Methane Production,*" pp. 1–100, A–1 through A–10, Sep. 2003.

U.S. Dept. of Energy—Office of Fossil Energy, "*Powder River Basin Coalbed Methane Development and Produced Water Management Study,*" pp. 1–111, A–1 through A14, Sep. 2003.

Notification of Transmittal of the International Search Report or the Declaration (PCT Rule 44.1) mailed Nov. 6, 2003 (8 pages) re International Application No. PCT/US 03/21626, Jul. 11, 2003.

Notification of Transmittal of the International Search Report or the Declaration (PCT Rule 44.1) mailed Nov. 5, 2003 (8 pages) re International Application No. PCT/US 03/21627, filed Jul. 11, 2003.

Notification of Transmittal of the International Search Report or the Declaration (PCT Rule 44.1) mailed Nov. 4, 2003 (7 pages) re International Application No. PCT/US 03/21628, filed Jul. 11, 2003.

Notification of Transmittal of the International Search Report or the Declaration (PCT Rule 44.1) mailed Dec. 5, 2003 (8 pages) re International Application No. PCT/US 03/21750, filed Jul. 11, 2003.

Examiner of Record, Office of Action Response regarding the Interpretation of the three Russian Patent Applications listed above under Foreign Patent Documents (9 pages), date unknown.

B. Gotas et al., "*Performance of Openhole Completed and Cased Horizontal/Undulating Wells in Thin–Bedded, Tight Sand Gas Reservoirs,*" Society of Petroleum Engineers, Inc., Oct.17 through Oct. 19, 2000, p. 1–7.

R. Sharma, et al., "*Modeling of Undulating Wellbore Trajectories, The Journal of Canadian Petroleum Technology*", XP–002261908, Oct. 18–20, 1993, pp 16–24.

E. F. Balbinski et al., "*Prediction of Offshore Viscous Oil Field Performance,*" European Symposium on Improved Oil Recovery, Aug. 18–20, 1999, pp. 1–10.

Chi, Weiguo, "*A Feasible Discussion on Exploitation Coalbed Methane through Horizontal Network Drilling in China*", SPE 64709, Society of Petroleum Engineers (SPE International), 4 pages, Nov. 7, 2000.

Chi, Weiguo, "*Feasibility of Coalbed Methane Exploitation in China*", synopsis of paper SPE 64709, 1 page, Nov. 7, 2000.

Ian D. Palmer et al., "*Coalbed Methane Well Completions and Stimulations*", Chapter 14, pp. 303–339, Hydrocarbons from Coal, Published by the American Association of Petroleum Geologists, 1993.
Robert W. Taylor and Richard Russell, Multilateral Technologies Increase Operational Efficiencies in Middle East, Oil & Gas Journal, pp. 76–80, Mar. 16, 1998.
Adam Pasiczynk, "Evolution Simplifies Multilateral Wells", Directional Drilling, pp. 53–55, Jun. 2000.
Steven S. Bell, "Multilateral System with Full Re–Entry Access Installed", World Oil, p. 29, Jun. 1996.
P. Jackson and S. Kershaw, Reducing Long Term Methane Emissions Resulting from Coal Mining, Energy Convers. Mgmt, vol. 37, Nos. 6–8, pp. 801–806, 1996.
Pascal Breant, "Des Puits Branches, Chez Total : les puits multi drains", Total Exploration Production, pp. 1–5, Jan. 1999.
McCray and Cole, "Oil Well Drilling and Technology," *University of Oklahoma Press,* pp 315–319, 1959.
Berger and Anderson, "Modern Petroleum;"*PennWell Books,* pp 106–108, 1978.
Howard L. Hartman, et al.; "SME Mining Engineering Handbook;" *Society of Mining, Metallurgy, and Exploration, Inc.;* pp 1946–1950, 2nd Edition, vol. 2, 1992.
Dave Hassan, Mike Chernichen, Earl Jensen, and Morley Frank; "Multi–lateral technique lowers drilling costs, provides environmental benefits", *Drilling Technology,* pp. 41–47, Oct. 1999.
Gopal Ramaswamy, "Production History Provides CBM Insights, " *Oil & Gas Journal,* pp. 49, 50 and 52, Apr. 2, 2001.
Arfon H. Jones et al., A Review of the Physical and Mechanical Properties of Coal with Implications for Coal–Bed Methane Well Completion and Production, *Rocky Mountain Association of Geologists,* pp. 169–181, 1988.
Joseph C. Stevens, Horizontal Applications For Coal Bed Methane Recovery, *Strategic Research Institute,* pp. 1–10 (slides), Mar. 25, 2002.
Weiguo Chi and Luwu Yang, "Feasibility of Coalbed Methane Exploitation in China," *Horizontal Well Technology,* p, 74, Sep. 2001.
Nackerud Product Description, *Harvest Tool Company,LLC,* 1 page, received Sep. 27, 2001.
Gopal Ramaswamy, "Advances Key For Coalbed Methane," *The American Oil& Gas Reporter,* pp. 71 & 73, Oct. 2001.
R.J. "Bob" Stayton, "Horizontal Wells Boost CBM Recovery", Special Report: Horizontal & Directional Drilling, *The American Oil& Gas Reporter,* pp. 71–75, Aug. 2002.
U.S. Appl. No. 09/769,098, entitled "Method and System for Enhanced Access to a Subterranean Zone," filed Jan. 24, 2001, 65 pages.
U.S. Appl. No. 09/774,996, entitled "Method and System for Accessing a Subterranean Zone From a Limited Surface Area," filed Jan. 30, 2001, 67 pages.
U.S. Appl. No. 09/788,897, entitled "Method and System for Accessing Subterranean Deposits From The Surface," filed Feb. 20, 2001, 54 pages.
U.S. Appl. No. 10/142,817, entitled "Method and System for Underground Treatment of Materials," filed May 8, 2002, 54 pgs, May 2, 2002.
U.S. Appl. No. 09/885,219, entitled "Method and System for Accessing Subterranean Deposits From The Surface," filed Jun. 20, 2001, 52 pages.
U.S. Appl. No. 10/046,001, entitled "Method and System for Management of By–Products From Subterranean Zones," filed Oct. 19, 2001. 42 pages.
U.S. Appl. No. 10/004,316, entitled "Slant Entry Well System and Method," filed Oct. 30, 2001, 35 pages.
U.S. Appl. No. 10/123,561, entitled "Method and System for Accessing Subterranean Zones From a Limited Surface," filed Apr. 5, 2002, 49 pages.
U.S. Appl. No. 10/123,556, entitled "Method and System for Accessing Subterranean Zones From a Limited Surface," filed Apr. 5, 2002, 49 pages.
U.S. Appl. No. 10/165,625, entitled "Method and System for Accessing Subterranean Deposits from the Surface," filed Jun. 7, 2002, 26 pages.
Pend Pat App, Joseph A. Zupanick, "*Method and System for Accessing a Subterranean Zone From a Limited Surface,*" U.S. Appl. 10/188,141, filed Jul. 1, 2002.
Pend Pat App, Joseph A. Zupanick, "*Undulating Well Bore,*" U.S. Appl. No. 10/194,366, filed Jul. 12, 2002.
Pend Pat App, Joseph A. Zupanick, "*RampingWell Bores* " U.S. Appl. 10/194,367, filed Jul. 12, 2002.
Pend Pat App, Joseph A. Zupanick, "*Wellbore Sealing System and Method,*" U.S. Appl. No. 10/194,.368, filed Jul. 12, 2002.
Pend Pat App, Joseph A. Zupanick, "*Wellbore Plug System and Method,*" U.S. Appl. No. 10/194,422, filed Jul. 12, 2002.
Pend Pat App, Joseph A. Zupanick, "*System and Method for Subterranean Access*" U.S. Appl. No. 10/227,057, filed Aug. 22, 2002.
Pend Pat App, Joseph A. Zupanick et al., *Method and System for Controlling Pressure in a Dual Well System,* Sep. 12, 2002.
Pend Pat App, Joseph A. Zupanick, "Three–Dimensional Well System for Accessing Subterranean Zones", U.S. Appl. 10/244,083, filed Sep. 12, 2002.
Pend Pat App, Joseph A. Zupanick, "Accelerated Production of Gas From a Subterranean Zone", U.S. Appl. 10/246,052, filed Oct. 3, 2002.
Pend Pat App, Joseph A. Zupanick, "Method and System for Removing Fluid From a Subterranean Zone Using an Enlarged Cavity", U.S. Appl. No. 10/264,535, filed Oct. 8, 2002.
Pend Pat App, Joseph A. Zupanick, "Method of Drilling Lateral Wellbores From a Slant Wall Without Utilizing a Whipstock", U.S. Appl. 10/267,426, filed Dec. 18, 2002.
Susan Eaton, "Reversal of Fortune", New Technology Magazine, pp 30–31, Sep. 2002.
James Mahony, "A Shadow of Things to Come", New Technology Magazine, pp. 28–29, Sep. 2002.
Documents Received from Third Party, Great Lakes Directional Drilling, Inc., (12 pages), Received Sep. 12, 2002.
U.S. Department of Energy, "Slant Hole Drilling," Mar. 1999, 1 page.
Notification of Transmittal of the International Search Report or the Declaration (PCT Rule 44.1) mailed Feb. 9, 2004 (6 pages) re International Application No. PCT/US 03/28138, Sep. 9, 2003.
Notification of Transmittal of the International Search Report or the Declaration (PCT Rule 44.1) mailed Feb. 27, 2004 (9 pages) re International Application No. PCT/US 03/30126, Sep. 23, 2003.
Fletcher, "Anadarko Cuts Gas Route Under Canadian River Gorge," Oil Gas Journal, pp. 28–30, Jan. 25, 2004.

Translation of selected pages of Kalinin, et al., "Drilling Inclined and Horizontal Well Bores," Nedra Publishers, Moscow, 1997, 15 pages.

Translation of selected pages of Arens, V.Zh., "Well–Drilling Recovery of Minerals," Geotechnology, Nedra Publishers, Moscow, 7 pages, 1986.

Notification of Transmittal of the International Search Report or the Declaration (PCT Rule 44.1) (3 pages) and International Search Report (7 pages) re International Application No. PCT/US 03/04771 mailed Jul. 4, 2003.

Notification of Transmittal of the International Search Report or the Declaration (PCT Rule 44.1) (3 pages) and International Search Report (5 pages) re International Application No. PCT/US 03/21891 mailed Nov. 13, 2003.

Desai, Praful, et al., "*Innovative Design Allows Construction of Level 3 or Level 4 Junction Using the Same Platform,*" SPE/Petroleum Society of CIM/CHOA 78965, Canadian Heavy Oil Association, 2002, pp. 1–11.

Bybee, Karen, "*Advanced Openhole Multilaterals,*" Horizontal Wells, Nov. 2002, pp. 41–42.

Bybee, Karen, "*A New Generation Multilateral System for the Troll Olje Field,*" Multilateral/Extended Reach, Jul. 2002, pp. 50–51.

Emerson,, A.B., et al., "*Moving Toward Simpler, Highly Functional Multilateral Completions,*" Technical Note, Journal of Canadian Petroleum Technology, May 2002, vol. 41, No. 5, pp. 9–12.

Moritis, Guntis, "*Complex Well Geometries Boost Orinoco Heavy Oil Producing Rates,*" XP–000969491, Oil & Gas Journal, Feb. 28, 2000, pp. 42–46.

Themig, Dan, "*Multilateral Thinking,*" New Technology Magazine, Dec. 1999, pp. 24–25.

Smith, R.C., et al., "*The Lateral Tie–Back System: The Ability to Drill and Case Multiple Laterals,*" IADC/SPE 27436, Society of Petroleum Engineers, 1994, pp. 55–64, plus Multilateral Services Profile (1 page) and Multilateral Services Specifications (1 page).

Notification of Transmittal of the International Search Report or the Declaration (PCT Rule 44.1) (3 pages) and International Search Report (4 pages) re International Application No. PCT/US 03/13954 mailed Sep. 1, 2003.

Logan, Terry L., "*Drilling Techniques for Coalbed Methane,*" Hydrocarbons From Coal, Chapter 12, Cover Page, Copyright Page, pp. 269–285, Copyright 1993.

Hanes, John, "*Outbursts in Leichhardt Colliery: Lessons Learned,*" International Symposium–Cum–Workshop on Management and Control of High Gas Emissions and Outbursts in Underground Coal Mines, Wollongong, NSW, Australia, Mar. 20–24, 1995, Cover page, pp. 445–449.

Williams, Ray, et al., "*Gas Reservoir Properties for Mine Gas Emission Assessment,*" Bowen Basin Symposium 2000, pp. 325–333.

Brown, K., et al., "*New South Wales Coal Seam Methane Potential,*" Petroleum Bulletin 2, Department of Mineral Resources, Discovery 2000, Mar. 1996, pp. i–viii, 1–96.

Fipke, S., et al., "*Economical Multilateral Well Technology for Canadian Heavy Oil,*" Petroleum Society, Canadian Institute of Mining, Metallurgy & Petroleum, Paper 2002–100, to be presented in Calgary Alberta, Jun. 11–13, 2002, pp. 1–11.

PowerPoint Presentation entitled, "Horizontal Coalbed Methane Wells," by Bob Stayton, Computalog Drilling Services, date is believed to have been in 2002 (39 pages).

Denney, Dennis, "*Drilling Maximum–Reservoir–Contact Wells in the Shaybah Field,*" SPE 85307, pp. 60, 62–63, Oct. 20, 2003.

Notification of Transmittal of the International Search Report or the Declaration (PCT Rule 44.1) (3 pages) and International Search Report (4 pages) re International Application No. PCT/US 03/38383 mailed Jun. 2, 2004.

Kalinin, et al., Translation of Selected Pages from Ch. 4, Sections 4.2 (p. 135), 10.1 (p. 402), 10.4 (pp. 418–419), "*Drilling Inclined and Horizontal Well Bores,*" Moscow, Nedra Publishers, 4 pages, 1997.

Jet Lavanway Exploration, "*Well Survey,*" Key Energy Surveys, 3 pages, Nov. 2, 1997.

Precision Drilling, "*We Have Roots in Coal Bed Methane Drilling,*" Technology Services Group, 1 page, Published on or before Aug. 5, 2002.

U.S. Dept. of Energy, "*New Breed of CBM/CMM Recovery Technology,*" 1 page, Jul. 2003.

Ghiselin, Dick, "*Unconventional Vision Frees Gas Reserves,*" Natural Gas Quarterly, 2 pages, Sep. 2003.

CBM Review, World Coal, "*US Drilling into Asia,*" 4 pages, Jun. 2003.

Skrebowski, Chris, "*US Interest in North Korean Reserves,*" Petroleum, Energy Institute, 4 pages, Jul. 2003.

Rial et al., U.S. Appl. No. 10/328,408, entitled "Method and System for Controlling the Production Rate Of Fluid From A Subterranean Zone To Maintain Production Bore Stability In The Zone," Dec. 23, 2002.

Zupanick, et al., U.S. Appl. No. 10/457,103, entitled "Method and System for Recirculating Fluid in a Well System," Jun. 5, 2003.

Zupanick, U.S. Appl. No. 10/630,345, entitled "Method and System for Accessing Subterranean Deposits from the Surface and Tools Therefor," Jul. 29, 2003.

Zupanick, U.S. Appl. No. 10/641,856, entitled "Method and System for Accessing Subterranean Deposits From the Surface," Aug. 15, 2003.

Pauley, Steven, U.S. Appl. No. 10/715,300, entitled "Multi–Purpose Well Bores and Method for Accessing a Subterranean Zone From the Surface," Nov. 17, 2003.

Seams, U.S. Appl. No. 10/723,322, entitled "Method and System for Extraction of Resources from a Subterranean Well Bore," Nov. 26, 2003.

Zupanick, U.S. Appl. No. 10/749,884, "Slant Entry Well System and Method," Dec. 31, 2003.

Zupanick, U.S. Appl. No. 10/761,629, entitled "Method and System for Accessing Subterranean Deposits from the Surface," Jan. 20, 2004.

Zupanick, U.S. Appl. No. 10/769,221, entitled "Method and System for Testing A Partially Formed Hydrocarbon Well for Evaluation and Well Planning Refinement, " Jan. 30, 2004.

Platt, "Method and System for Lining Multilateral Wells, " U.S. Appl. No. 10/772,841, Feb. 5, 2004.

Zupanick, "Three–Dimentsional Well System For Accessing Subterranean Zones," Feb. 11, 2004, U.S. Appl. No. 10/777,503.

Zupancik, "System And Method For Directional Drilling Utilizing Clutch Assembly," U.S. Appl. No. 10/811,118, Mar. 25, 2004.

Zupanick et al., "Slot Cavity," U.S. Appl. No. 10/419,529, Apr. 21, 2003.

Zupanick, "System and Method for Multiple Wells from a Common Surface Location," U.S. Appl. No. 10/788,694, Feb. 27, 2004.

Zupanick, "Method and System for Accessing a Subterranean Zone From Limited Surface Area," U.S. Appl. No. 10/406,037, Apr. 2, 2003.

Field, T.W., "*Surface to In–seam Drilling—The Australian Experience,*" 10 pages, Undated.

Drawings included in CBM well permit issued to CNX stamped Apr. 15, 2004 by the West Virginia Department of Environmenal Protection (4 pages).

Website of Mitchell Drilling Contractors, "*Services: Dymaxion—Surface to In–Seam,*" http://www.mitchelldrilling.com/dymaxion.htm, printed as of Jun. 17, 2004, 4 pages.

Website of CH4, "*About Natural Gas—Technology,*" http://ch4.com.au/ng_technology.html, copyright 2003, printed as of Jun. 17, 2004, 4 pages.

Thomson, et al., "The Application of Medium Radius Directional Drilling for Coal Bed Methane Extraction," Lucas Technical Paper, copyrighted 2003, 11 pages.

U.S. Department of Energy, DE–FC26–01NT41148, "*Enhanced Coal Bed Methane Production and Sequestration of CO2 in Unmineable Coal Seams,*" for Consol, Inc., accepted Oct. 1, 2001, 48 pages, including cover page.

Notification of Transmittal of the International Search Report and the Written Opinion of the International Searching Authority, or the Declaration (3 pages), International Search Report (5 pages) and Written Opinion of the International Searching Authority (6 pages) re International Application No. PCT/US2004/012029 mailed Sep. 22, 2004.

Brunner, D.J. and Schwoebel, J.J., "Directional Drilling for Methane Drainage and Exploration in Advance of Mining," REI Drilling Directional Underground, World Coal, 1999 10 pages.

Thakur, P.C., "A History of Coalbed Methane Drainage From United States Coal Mines," 2003 SME Annual Meeting, Feb. 24–26, Cincinnati, Ohio, 4 pages.

U.S. Climate Change Technology Program, "Technology Options for the Near and Long Term," 4.1.5 Advances in Coal Mine Methane Recovery System, pp. 162–164.

Notification of Transmittal of the International Search Report and the Written Opinion of the International Searching Authority, or the Declaration (3 pages), International Search Report (3 pages) and Written Opinion of the International Searching Authority (7 pages) re International Application No. PCT/US2004/017048 mailed Oct. 21, 2004.

Gardes, Robert, "Multi–Seam Completion Technology," Natural Gas Quarterly, E&P, Jun. 2004, pp. 78–81.

Baiton, Nicholas, "Maximize Oil Production and Recovery," Vertizontal Brochure, received Oct. 2, 2002, 4 pages.

Dreiling, Tim, McClelland, M.L. and Bilyeu, Brad, "Horizontal & High Angle Air Drilling in the San Juan Basin, New Mexico," Dated on or about Mar. 6, 2003, pp. 1–11.

Fong, David K., Wong, Frank Y., and McIntyre, Frank J., "An Unexpected Benefit of Horizontal Wells on Offset Vertical Well Productivity in Vertical Miscible Floods," Canadian SPE/CIM/CANMET Paper No. HWC94–09, paper to be presented Mar. 20–23, 1994, Calgary, Canada, 10 pages.

Fischer, Perry A., "What's Happening in Production," World Oil, Jun. 2001, p. 27.

Website of PTTC Network News Volume 7, 1st Quarter 2001, Table of Contents, *http://www.pttc.org/../news/v7n1nn4.htm* printed Apr. 25, 2003, 3 pages.

Cox, Richard J.W., "Testing Horizontal Wells While Drilling Underbalanced," Delft University of Technology, Aug. 1998, 68 pages.

McLennan, John, et al., "Underbalanced Drilling Manual," Gas Research Institute, Chicago, Illinois, GRI Reference No. GRI–97/0236, copyright 1997, 502 pages.

The Need for a Viable Multi–Seam Completion Technology for the Power River Basin, Current Practice and Limitations, Gardes Energy Services, Inc., Believed to be 2003 (8 pages).

Langley, Diane, "Potential Impact of Microholes Is Far From Diminutive," JPT Online, http://www.spe.org/spe/jpt/jps, Nov. 2004 (5 pages).

Consol Energy Slides, "Generating Solutions, Fueling Change," Presented at Appalachian E&P Forum, Harris Nesbitt Corp., Boston, Oct. 14, 2004 (29 pages).

Notification of Transmittal of the International Search Report and the Written Opinion of the International Searching Authority (5 pages) re International Application No. PCT/US2004/024518 mailed Nov. 10, 2004.

Schenk, Christopher J., "Geologic Definition and Resource Assessment of Continous (Unconventional) Gas Accumulations–the U.S. Experience," Website, http://aapg.confex.com/...//, printed Nov. 16, 2004 (1 page).

U.S. Department of Interior, U.S. Geological Survey, "Characteristics of Discrete and Basin–Centered Parts of the Lower Silurian Regional Oil and Gas Accumulation, Appalachian Basin: Preliminary Results From a Data Set of 25 oil and Gas Fields," U.S. Geological Survey Open–File Report 98–216, Website, http://pubs.usgs.gov/of/1998/of98–216/introl.htm, printed Nov. 16, 2004 (2 pages).

Zupanick, J., "Coalbed Methane Extraction," 28th Mineral Law Conference, Lexington, Kentucky, Oct. 16–17, 2003 (48 pages).

Zupanick, J., "CDX Gas–Pinnacle Project," Presentation at the 2002 Fall Meeting of North American Coal Bed Methane Forum, Morgantown, West Virginia, Oct. 30, 2002 (23 pages).

Lukas, Andrew, Lucas Drilling Pty Ltd., "Technical Innovation and Engineering Xstrata –Oaky Creek Coal Pty Limited," Presentation at Coal Seam Gas & Mine Methane Conference in Brisbane, Nov. 22–23, 2004 (51 pages).

Field, Tony, Mitchell Drilling, "Let's Get Technical —Drilling Breakthrough in Surface to In–Seam in Australia," Presentation at Coal Seam Gas & Mine Methane Conference in Brisbane, Nov. 22–23, 2004 (20 pages).

Zupanick, Joseph A., "Coal Mine Methane Drainage Utilizing Multilateral Horizontal Wells," 2005 SME Annual Meeting & Exhibit, Feb. 28 –Mar. 2, 2005, Salt Lake City, Utah (6 pages).

The Official Newsletter of the Cooperative Research Centre for Mining Technology and Equipment, CMTE News 7, "Tight–Radius Drilling Clinches Award," Jun. 2001, 1 page.

Listing of 174 References received from Third Party on Feb. 16, 2005 (9 pages).

Gardes Directional Drilling, "Multiple Directional Wells From Single Borehole Developed," Reprinted from Jul. 1989 edition of Offshore, Copyright 1989 by Penn Well Publishing Company (4 pages).

"Economic Justification and Modeling of Multilateral Wells," Economic Analysis, Hart's Petroleum Engineer International, 1997 (4 pages).

Mike Chambers, "Multi–Lateral Completions at Mobil Past, Present, and Future," presented at the 1998 Summit on E&P Drilling Technologies, Strategic Research Institute, Aug. 18–19, 1998 in San Antonio, Texas (26 pages).
Davic C. Oyler and William P. Diamond, "Drilling a Horizontal Coalbed Methane Drainage System From a Directional Surface Borehole" PB82221516, National Technical Information Service, Bureau of Mines, Pittsburgh, PA, Pittsburgh Research Center, Apr. 1982 (56 pages).
P. Corlay, D. Bossie–Codreau, J.C. Sabathier and E.R. Delamaide, "Improving Reservoir Management With Complex Well Architectures," Field Production & Reservoir Management, World Oil, Jan. 1997 (5 pages).
Eric R. Skonberg and Hugh W. O'Donnell, "Horizontal Drilling for Underground Coal Gasification," presented at the Eighth Underground Coal Conversion Symposium, Keystone, Colorado, Aug. 16, 1982 (8 pages).
Gamal Ismail, A.S. Fada'q, S. Kikuchi, H. El Khatib, "Ten Years Experience in Horizontal Application & Pushing the Limits of Well Construction Approach in Upper Zakum Field (Offshore Abu Dhabi)," SPE 87284, Society of Petroleum Engineers, Oct. 2000 (17 pages).
Gamal Ismail, H. E–Khatib –ZADCO, Abu Dhabi, UAE, "Multi–Lateral Horizontal Drilling Problems & Solutions Experienced Offshore Abu Dhabi," SPE 36252, Society of Petroleum Engineers, Oct. 1996 (12 pages).
C.M. Matthews and L.J. Dunn, "Drilling and Production Practices to Mitigate Sucker Rod/Tubing Wear–Related Failures in Directional Wells," SPE 22852, Society of Petroleum Engineers, Oct. 1991 (12 pages).
H.H. Fileds, Stephen Krickovic, Albert Sainato, and M.G. Zabetakis, "Degasification of Virgin Pittsburgh Coalbed Through a Large Borehole," RI–7800, Bureau of Mines Report of Investigations/1973, U.S. Department of the Interior, 1973 (31 pages).
William P. Diamond, "Methane Control for Underground Coal Mines," IC–9395, Bureau of Mines Information Circular, U.S. Department of the Interior, 1994 (51 pages).
Dreiling, Tim, McClelland, M.L. and Bilyeu, Brad, "Horizontal & High Angle Air Drilling in the San Juan Basin, New Mexico," Believed to be dated Apr. 1996, pp. 1–11.
Technology Scene Drilling & Intervention Services, "Weatherford Moves Into Advanced Multilateral Well Completion Technology," and "Productivity Gains and Safety Record Speed Acceptance of UBS," *Reservoir Mechanics*, Weatherford International, Inc., 2000 Annual Report (2 pages).
"A Different Direction for CBM Wells," *W Magazine*, 2004 Third Quarter (5 pages).
Snyder, Robert E, "What's New in Production," *WorldOil Magazine*, Feb. 2005, [printed from the internet on Mar. 7, 2005], http://www.worldoil.com/magazine/MAGAZINE_DETAIL.asp?ART_ID–2507@Month_Year (3 pages).
Nazzal, Greg, "Moving Multilateral Systems to the Next Level, Strategic Acquisition Expands Weatherford's Capabilities,", 2000 (2 pages).
Bahr, Angie, "Methane Draining Technology Boosts Safety and Energy Production," Energy Review, Feb. 4, 2005, Website: www.energyreview.net/storyviewprint.asp, printed Feb. 7, 2005 (2 pages).
Molvar, Erik M., "Drilling Smarter: Using Directional Drilling to Reduce Oil and Gas Impacts in the Intermountain West," Prepared by Biodiversity Conservation Alliance, Report issued Feb. 18, 2003, 34 pages.
King, Robert F., "Drilling Sideways—A Review of Horizontal Well Technology and Its Domestic Applicatioin," DOE/EIA–TR–0565, U.S. Department of Energy, Apr. 1993, 30 pages.
Santos, Helio, SPE, Impact Engineering Solutions and Jesus Olaya, Ecopetrol/ICP, "*No–Damage Drilling: How to Achieve this Challenging Goal?,*" SPE 77189, Copyright 2002, presented at the IADC/SPE Asia Pacific Drilling Technology, Jakarta, Indonesia, Sep. 9–Nov. 2002, 10 pages.
Santos Helio, SPE, Impact Engineering, Solutions,"*Increasing Leakoff Pressure with New Class of Drilling Fluid,*"SPE 78243, Copyright 2002, presented at the SPE/ISRM Rock Mechanics Conference in Irving, Texas, Oct. 20–23, 2002, 7 pages.
Franck Labenski, Paul Reid, SPE, and Helio Santos, SPE, Impact Solutions Group, "Drilling Fluids Approaches for Control of Wellbore Instability in Fractured Formations," SPE/IADC 85304, Society of Petroleum Engineers, Copyright 2003, presented at the SPE/IADC Middle East Drilling Technology Conference & Exhibition in Abu Chahi, UAE, Oct. 20–22, 2003, 8 pages.
P. Reid, SPE, and H. Santos, SPE, Impact Solutions Group, "*Novel Drilling, Completion and Workover Fluids for Depleted Zones: Avoiding Losses, Formation Damage and Stuck Pipe,*" SPE/IADC 85326, Society of Petroleum Engineers, Copyright 2003, presented at the SPE/IADC Middle East Drilling Conference & Exhibition in Abu Chabi, UAE, Oct. 20–22, 2003, 9 pages.
Craig C. White and Adrian P. Chesters, NAM; Catalin D. Ivan, Sven Maikranz and Rob Nouris, M–I L.L.C., "*Aphron–based drilling fluid: Novel technology for drilling depleted formations,*"World Oil, Drilling Report Special Focus, Oct. 2003, 5 pages.
Robert E. Snyder, "Drilling Advances,", World Oil, Oct. 2003, 1 page.
U.S. Environmental Protection Agency, "Directional Drilling Technology," prepared for the EPA by Advanced Resources International under Contract 68–W–00–094, Coalbed Methane Outreach Program (CMOP), Website: http://search.epa.gov/s97is.vts, printed Mar. 17, 2005, 13 pages.

* cited by examiner

METHOD AND SYSTEM FOR CIRCULATING FLUID IN A WELL SYSTEM

RELATED APPLICATIONS

This application is a continuation-in-part of U.S. application Ser. No. 09/788,897 filed Feb. 20, 2001 now U.S. Pat. No. 6,732,792 by Joseph A. Zupanick entitled Method and System for Accessing Subterranean Deposits from the Surface, which is a divisional patent application of Ser. No. 09/444,029 filed Nov. 19, 1999 now U.S. Pat. No. 6,357,523 and entitled Method and System for Accessing Subterranean Deposits from the Surface, which is a continuation-in-part application Ser. No. 09/197,687 of U.S. Pat. No. 6,280,000 filed Nov. 20, 1998 and entitled Method for Production of Gas from a Coal Seam.

TECHNICAL FIELD OF THE INVENTION

The present invention relates generally to systems and methods for the recovery of subterranean resources and, more particularly, to a method and system for circulating fluid in a well system.

BACKGROUND OF THE INVENTION

Subterranean deposits of coal, also referred to as coal seams, contain substantial quantities of entrained methane gas. Production and use of methane gas from coal deposits has occurred for many years. Substantial obstacles, however, have frustrated more extensive development and use of methane gas deposits in coal seams.

For example, one problem of production of gas from coal seams may be the difficulty presented at times by over-balanced drilling conditions caused by low reservoir pressure and aggravated by the porosity of the coal seam. During both vertical and horizontal surface drilling operations, drilling fluid is used to remove cuttings from the well bore to the surface. The drilling fluid exerts a hydrostatic pressure on the formation which, when exceeding the pressure of the formation, can result in a loss of drilling fluid into the formation. This results in entrainment of drill cuttings in the formation, which tends to plug the pores, cracks, and fractures that are needed to produce the gas.

Certain methods are available to drill in an under-balanced state. Using a gas such as nitrogen in the drilling fluid reduces the hydrostatic pressure, but other problems can occur, including increased difficulty in maintaining a desired pressure condition in the well system during drill string tripping and connecting operations.

SUMMARY OF THE INVENTION

The present invention provides a method and system for circulating fluid in a well system that substantially eliminates or reduces at least some of the disadvantages and problems associated with previous fluid circulation methods and systems.

In accordance with a particular embodiment of the present invention, a method for circulating drilling fluid in a well system includes drilling a substantially vertical well bore from a surface to a subterranean zone and drilling an articulated well bore from the surface to the subterranean zone using a drill string. The articulated well bore is horizontally offset from the substantially vertical well bore at the surface and intersects the substantially vertical well bore at a junction proximate the subterranean zone. The method includes drilling a drainage bore from the junction into the subterranean zone and pumping a drilling fluid through the drill string when drilling the drainage bore. The drilling fluid exits the drill string proximate a drill bit of the drill string. The method also includes providing fluid down the substantially vertical well bore through a tubing. The tubing has an opening at the junction such that the fluid exits the tubing at the junction. A fluid mixture returns up the substantially vertical well bore outside of the tubing. The fluid mixture comprises the drilling fluid after the drilling fluid exits the drill string.

The fluid provided down the substantially vertical well bore may comprise gas, such as compressed air. The fluid mixture returning up the substantially vertical well bore may comprise gas provided down the substantially vertical well bore through the tubing after the gas exits the tubing, fluid from the subterranean zone or cuttings from the subterranean zone. The method may also include varying a flow rate of the fluid provided down the substantially vertical well bore to achieve control a bottom hole pressure to achieve an under-balanced, over-balanced or balanced drilling condition.

In accordance with another embodiment, a method for circulating drilling fluid in a well system includes drilling a substantially vertical well bore from a surface to a subterranean zone and drilling an articulated well bore from the surface to the subterranean zone using a drill string. The articulated well bore is horizontally offset from the substantially vertical well bore at the surface and intersects the substantially vertical well bore at a junction proximate the subterranean zone. The method includes drilling a drainage bore from the junction into the subterranean zone and pumping a drilling fluid through the drill string when drilling the drainage bore. The drilling fluid exits the drill string proximate a drill bit of the drill string. The method also includes providing a pump string down the substantially vertical well bore. The pump string comprises a pump inlet proximate the junction. The method includes pumping a fluid mixture up the substantially vertical well bore through the pump string, the fluid mixture entering the pump string at the pump inlet. The method may include varying the speed of the pumping of the fluid mixture up the substantially vertical well bore through the pump string to control a bottom hole pressure to achieve a desired drilling condition, such as an over-balanced, under-balanced or balanced drilling condition.

Technical advantages of particular embodiments of the present invention include a method and system for circulating drilling fluid in a well system that includes providing gas down a substantially vertical well bore. The flow rate of the gas provided down the substantially vertical well bore may be varied in order to achieve a desired drilling condition, such as an over-balanced, under-balanced or balanced drilling condition. Accordingly, the flexibility of the drilling and retrieval process may be improved.

Another technical advantage of particular embodiments of the present invention includes a level of fluid in an articulated well bore that acts as a fluid seal to resist the flow of formation fluid that might escape the drill rig during a drilling process. The formation fluid resisted may comprise poisonous gas, such as hydrogen sulfide. Accordingly, drilling equipment and personnel may be isolated from the flow of poisonous gas to the surface thus increasing the safety of the drilling system.

Still another technical advantage of particular embodiments of the present invention is a method and system for circulating drilling fluid in a well system that includes pumping a fluid mixture up a substantially vertical well bore through a pump string. The fluid mixture may comprise drilling fluid used in the drilling process and cuttings from the subterranean zone. Gas from the subterranean zone may bypass the pump string enabling such gas to be recovered or flared separately from other fluid in the drilling system. Moreover, the speed of the pumping of the fluid mixture up the substantially vertical well bore may be varied to achieve a desired drilling condition, such as an over-balanced, under-balanced or balanced drilling condition.

Other technical advantages will be readily apparent to one skilled in the art from the figures, descriptions and claims included herein. Moreover, while specific advantages have been enumerated above, various embodiments may include all, some or none of the enumerated advantages.

BRIEF DESCRIPTION OF THE DRAWINGS

For a more complete understanding of particular embodiments of the invention and their advantages, reference is now made to the following descriptions, taken in conjunction with the accompanying drawings, in which.

DETAILED DESCRIPTION OF THE INVENTION

Figure 1:
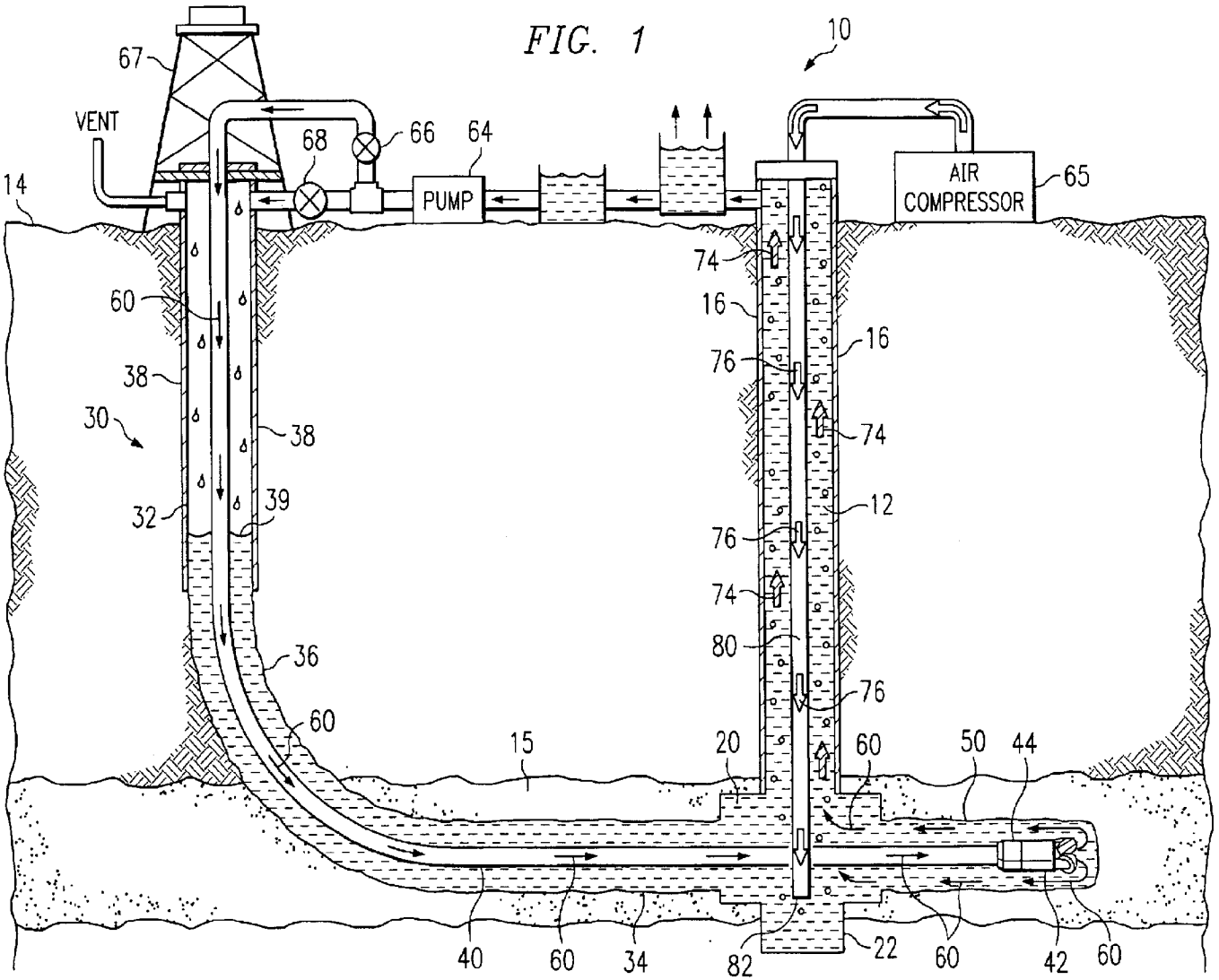
FIG. 1 illustrates the circulation of fluid in a well system in which a fluid is provided down a substantially vertical well bore through a tubing, in accordance with an embodiment of the present invention.

FIG. 1 illustrates the circulation of fluid in a well system 10. The well system includes a subterranean zone that may comprise a coal seam. It will be understood that other subterranean zones can be similarly accessed using the dual well system of the present invention to remove and/or produce water, hydrocarbons, gas and other fluids in the subterranean zone and to treat minerals in the subterranean zone prior to mining operations.

Referring to FIG. 1, a substantially vertical well bore 12 extends from a surface 14 to a target layer subterranean zone 15. Substantially vertical well bore 12 intersects and penetrates subterranean zone 15. Substantially vertical well bore 12 may be lined with a suitable well casing 16 that terminates at or above the level of the coal seam or other subterranean zone 15.

An enlarged cavity 20 may be formed in substantially vertical well bore 12 at the level of subterranean zone 15. Enlarged cavity 20 may have a different shape in different embodiments. Enlarged cavity 20 provides a junction for intersection of substantially vertical well bore 12 by an articulated well bore used to form a drainage bore in subterranean zone 15. Enlarged cavity 20 also provides a collection point for fluids drained from subterranean zone 15 during production operations. A vertical portion of substantially vertical well bore 12 continues below enlarged cavity 20 to form a sump 22 for enlarged cavity 20.

An articulated well bore 30 extends from the surface 14 to enlarged cavity 20 of substantially vertical well bore 12. Articulated well bore 30 includes a substantially vertical portion 32, a substantially horizontal portion 34, and a curved or radiused portion 36 interconnecting vertical and horizontal portions 32 and 34. Horizontal portion 34 lies substantially in the horizontal plane of subterranean zone 15 and intersects enlarged cavity 20 of substantially vertical well bore 12. In particular embodiments, articulated well bore 30 may not include a horizontal portion, for example, if subterranean zone 15 is not horizontal. In such cases, articulated well bore 30 may include a portion substantially in the same plane as subterranean zone 15.

Articulated well bore 30 may be drilled using an articulated drill string 40 that includes a suitable down-hole motor and drill bit 42. A drilling rig 67 is at the surface. A measurement while drilling (MWD) device 44 may be included in articulated drill string 40 for controlling the orientation and direction of the well bore drilled by the motor and drill bit 42. The substantially vertical portion 32 of the articulated well bore 30 may be lined with a suitable casing 38.

After enlarged cavity 20 has been successfully intersected by articulated well bore 30, drilling is continued through enlarged cavity 20 using articulated drill string 40 and appropriate horizontal drilling apparatus to drill a drainage bore 50 in subterranean zone 15. Drainage bore 50 and other such well bores include sloped, undulating, or other inclinations of the coal seam or subterranean zone 15.

During the process of drilling drainage bore 50, drilling fluid (such as drilling "mud") is pumped down articulated drill string 40 using pump 64 and circulated out of articulated drill string 40 in the vicinity of drill bit 42, where it is used to scour the formation and to remove formation cuttings. The drilling fluid is also used to power drill bit 42 in cutting the formation. The general flow of the drilling fluid through and out of drill string 40 is indicated by arrows 60.

System 10 includes a valve 66 and a valve 68 in the piping between articulated well bore 30 and pump 64. When drilling fluid is pumped down articulated drill string 40 during drilling, valve 66 is open. While connections are being made to articulated drill string 40, during tripping of the drill string or in other cases when desirable, valve 68 is opened to allow fluid (i.e. drilling fluid or compressed air) to be pumped down articulated well bore 30 outside of articulated drill string 40, in the annulus between articulated drill string 40 and the surfaces of articulated well bore 30. Pumping fluid down articulated well bore 30 outside of articulated drill string 40 while active drilling is not occurring, such as during connections and tripping of the drill string, enables an operator to maintain a desired bottom hole pressure of articulated well bore 30. Moreover, fluids may be provided through both valve 66 and valve 68 at the same time if desired. In the illustrated embodiment, valve 68 is partially open to allow fluid to fall through articulated well bore 30.

When pressure of articulated well bore 30 is greater than the pressure of subterranean zone 15 (the "formation pressure"), the well system is considered over-balanced.

When pressure of articulated well bore 30 is less than the formation pressure, the well system is considered under-balanced. In an over-balanced drilling situation, drilling fluid and entrained cuttings may be lost into subterranean zone 15. Loss of drilling fluid and cuttings into the formation is not only expensive in terms of the lost drilling fluids, which must be made up, but it tends to plug the pores in the subterranean zone, which are needed to drain the zone of gas and water.

A fluid, such as compressed air or another suitable gas, may be provided down substantially vertical well bore 12 through a tubing 80. In the illustrated embodiment, gas is provided through tubing 80; however it should be understood that other fluids may be provided through tubing 80 in other embodiments. The gas may be provided through the tubing using an air compressor 65, a pump or other means. The flow of the gas is generally represented by arrows 76. The tubing has an open end 82 at enlarged cavity 20 such that the gas exits the tubing at enlarged cavity 20.

The flow rate of the gas or other fluid provided down substantially vertical well bore 12 may be varied in order to change the bottom hole pressure of articulated well bore 30. Furthermore, the composition of gas or other fluid provided down substantially vertical well bore 12 may also be changed to change the bottom hole pressure. By changing the bottom hole pressure of articulated well bore 30, a desired drilling condition such as under-balanced, balanced or over-balanced may be achieved.

The drilling fluid pumped through articulated drill string 40 mixes with the gas or other fluid provided through tubing 80 forming a fluid mixture. The fluid mixture flows up substantially vertical well bore 12 outside of tubing 80. Such flow of the fluid mixture is generally represented by arrows 74 of FIG. 1. The fluid mixture may also comprise cuttings from the drilling of subterranean zone 15 and fluid from subterranean zone 15, such as water or methane gas. Drilling fluid pumped through articulated well bore 30 outside of articulated drill string 40 may also mix with the gas to form the fluid mixture flowing up substantially vertical well bore 12 outside of tubing 80.

Articulated well bore 30 also includes a level 39 of fluid. Level 39 of fluid may be formed by regulating the fluid pump rate of pump 64 and/or the injection rate of air compressor 65. Such level of fluid acts as a fluid seal to provide a resistance to the flow of formation fluid, such as poisonous formation gas (for example, hydrogen sulfide), up articulated well bore 30. Such resistance results from a hydrostatic pressure of the level of fluid in articulated well bore 30. Thus, rig 67 and rig personnel may be isolated from formation fluid, which may include poisonous gas, flowing up and out of articulated well bore 30 at the surface. Furthermore, a larger annulus in substantially vertical well bore 12 will allow for the return of cuttings to the surface at a lower pressure than if the cuttings were returned up articulated well bore 30 outside of articulated drill string 40.

A desired bottom hole pressure may be maintained during drilling even if additional collars of articulated drill string 40 are needed, since the amount of gas pumped down substantially vertical well bore 12 may be varied to offset the change in pressure resulting from the use of additional drill string collars.

Figure 2:
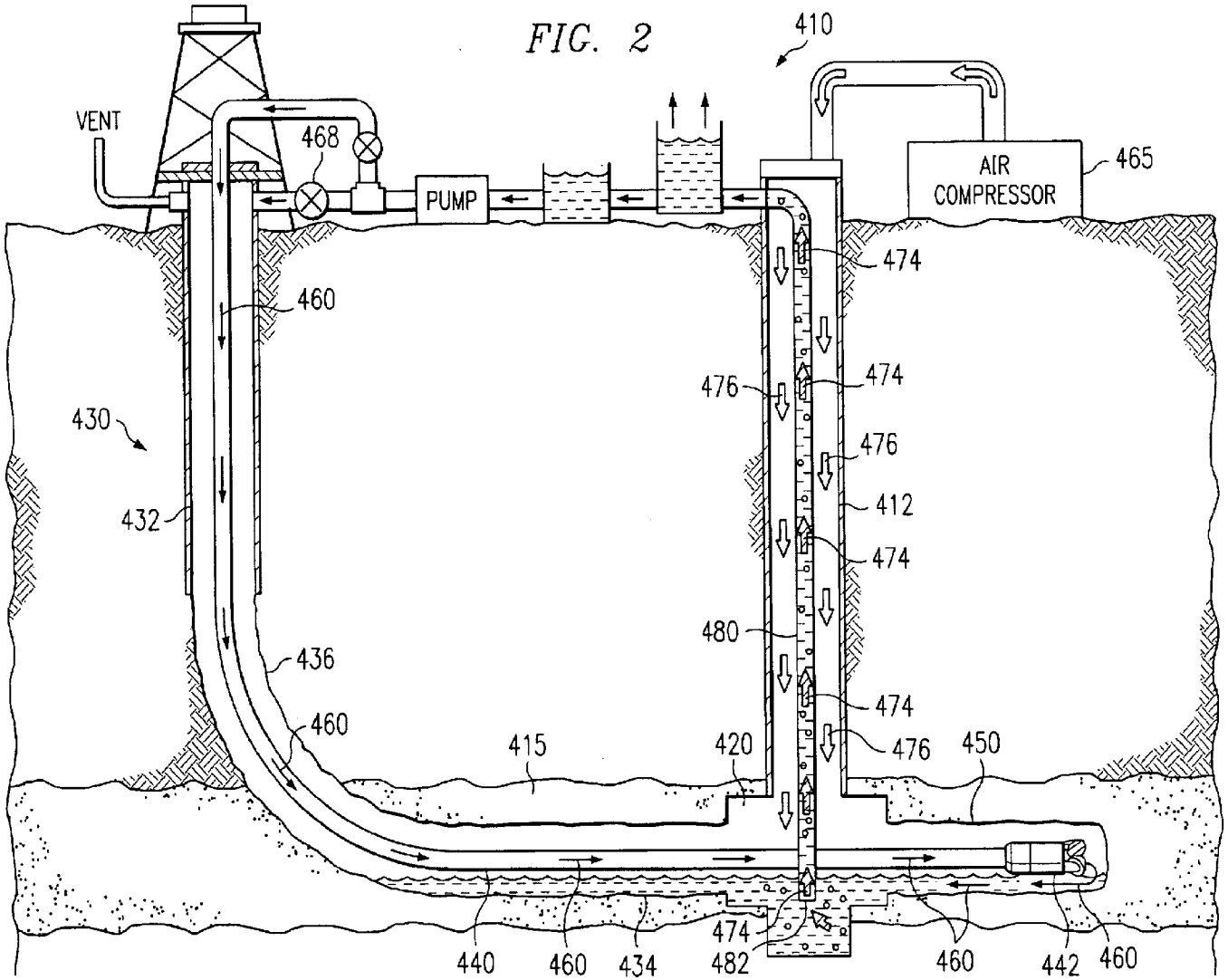
FIG. 2 illustrates the circulation of fluid in a well system in which a fluid is provided down a substantially vertical well bore, and a fluid mixture is returned up the well bore through a tubing, in accordance with an embodiment of the present invention.

FIG. 2 illustrates the circulation of fluid in a well system 410 in accordance with an embodiment of the present invention. System 410 is similar in many respects to system 10 of FIG. 1, however the circulation of fluid in system 410 differs from the circulation of fluid in system 10. System 410 includes a substantially vertical well bore 412 and an articulated well bore 430. Articulated well bore 430 intersects substantially vertical well bore 412 at an enlarged cavity 420. Articulated well bore 430 includes a substantially vertical portion 432, a curved portion 436 and a substantially horizontal portion 434. Articulated well bore intersects an enlarged cavity 420 of substantially vertical well bore 412. Substantially horizontal portion 434 of articulated well bore 430 is drilled through subterranean zone 415. Articulated well bore 430 is drilled using an articulated drill string 440 which includes a down-hole motor and a drill bit 442. A drainage bore 450 is drilled using articulated drill string 440.

A drilling fluid is pumped through articulated drill string 440 as described above with respect to FIG. 1. The general flow of such drilling fluid is illustrated by arrows 460. The drilling fluid may mix with fluid and/or cuttings from subterranean zone 450 after the drilling fluid exits articulated drill string 440. Using valve 468, fluids may be provided down articulated well bore 430 outside of articulated drill string 440 during connection or tripping operations or otherwise when desirable, such as the falling fluid illustrated in FIG. 1.

A fluid, such as compressed air, may be provided down substantially vertical well bore 412 in the annulus between a tubing 480 and the surface of substantially vertical well bore 412. In the illustrated embodiment, gas is provided down substantially vertical well bore 412 outside of tubing 480; however it should be understood that other fluids may be provided in other embodiments. The gas or other fluid may be provided using an air compressor 465, a pump or other means. The flow of the gas is generally represented by arrows 476.

The flow rate of the gas or other fluid provided down substantially vertical well bore 412 may be varied in order to change the bottom hole pressure of articulated well bore 430. Furthermore, the composition of gas or other fluid provided down substantially vertical well bore 412 may also be changed to change the bottom hole pressure. By changing the bottom hole pressure of articulated well bore 430, a desired drilling condition such as under-balanced, balanced or over-balanced may be achieved.

The drilling fluid pumped through articulated drill string 440 mixes with the gas or other fluid provided down substantially vertical well bore 412 outside of tubing 480 to form a fluid mixture. The fluid mixture enters an open end 482 of tubing 480 and flows up substantially vertical well bore 412 through tubing 480. Such flow of the fluid mixture is generally represented by arrows 474. The fluid mixture may also comprise cuttings from the drilling of subterranean zone 415 and fluid from subterranean zone 415, such as water or methane gas. Fluid pumped through articulated well bore 430 outside of articulated drill string 440 may also mix with the gas to form the fluid mixture flowing up substantially vertical well bore 412 outside of tubing 480.

Figure 3:
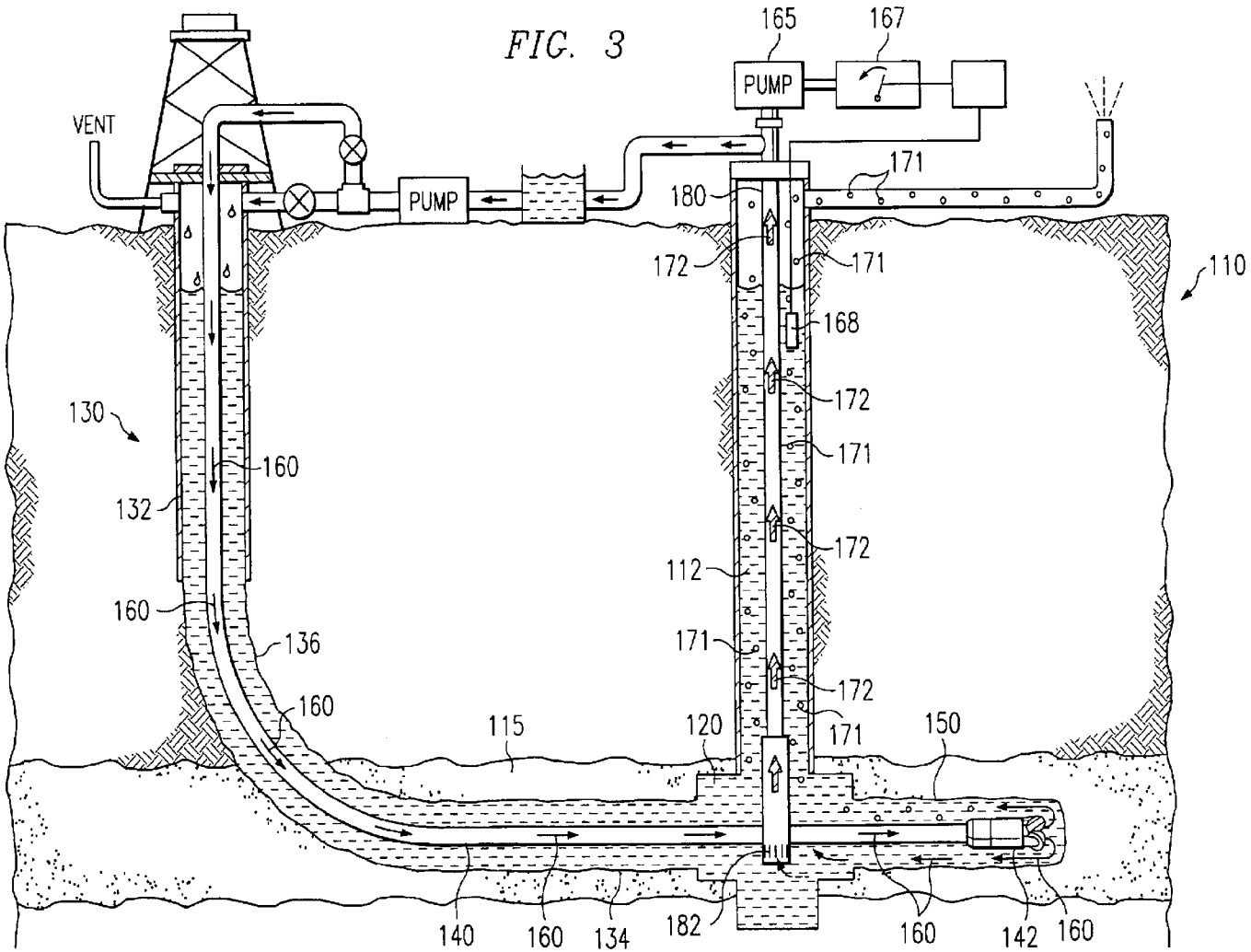
FIG. 3 illustrates the circulation of fluid in a well system in which a fluid mixture is pumped up a substantially vertical well bore through a pump string, in accordance with an embodiment of the present invention.

FIG. 3 illustrates the circulation of fluid in a well system 110 in accordance with an embodiment of the present invention. System 110 includes a substantially vertical well bore 112 and an articulated well bore 130. Articulated well bore 130 intersects substantially vertical well bore 112 at an enlarged cavity 120. Articulated well bore 130 includes a substantially vertical portion 132, a curved portion 136 and a substantially horizontal portion 134. Articulated well bore intersects an enlarged cavity 120 of substantially vertical well bore 112. Substantially horizontal portion 134 of articulated well bore 130 is drilled through subterranean zone 115.

Articulated well bore 130 is drilled using an articulated drill string 140 which includes a down-hole motor and a drill bit 142. A drainage bore 150 is drilled using articulated drill string 140.

Substantially vertical well bore 112 includes a pump string 180 which comprises a pump inlet 182 located at enlarged cavity 120. A drilling fluid is pumped through articulated drill string 140 as described above with respect to FIG. 1. The general flow of such drilling fluid is illustrated by arrows 160. The drilling fluid may mix with fluid and/or cuttings from subterranean zone 150 to form a fluid mixture after the drilling fluid exits articulated drill string 140.

The fluid mixture is pumped up through substantially vertical well bore 112 through pump inlet 182 and pump string 180 using pump 165, as generally illustrated by arrows 172. Formation gas 171 from subterranean zone 115 flows up substantially vertical well bore 112 to areas of lower pressure, bypassing pump inlet 182. Thus, particular embodiments of the present invention provide a manner for pumping fluid out of a dual well system through a pump string and limiting the amount of formation gas pumped through the pump string. Formation gas 171 may be flared as illustrated or recovered.

The speed of the pumping of the fluid mixture up substantially vertical well bore 112 through pump string 180 may be varied to change the fluid level and bottom hole pressure of system 110. By changing the fluid level and bottom hole pressure, a desired drilling condition such as under-balanced, balanced or over-balanced may be achieved. Substantially vertical well bore 112 includes a pressure sensor 168 operable to detect a pressure in substantially vertical well bore 112. Pressure sensor 168 may be electrically coupled to an engine 167 of pump 165 to automatically change the speed of pump 165 based on the pressure at a certain location in system 110. In other embodiments, the speed of pump 165 may be varied manually to achieve a desired drilling condition.

While connections are being made to articulated drill string 140, during tripping of the drill string or in other cases when desirable, drilling fluid may be pumped through articulated well bore 130 outside of articulated drill string 140. Such drilling fluid may mix with fluid and/or cuttings from subterranean zone 150 to form the fluid mixture pumped up substantially vertical well bore 112 through pump string 180.

Figure 4:
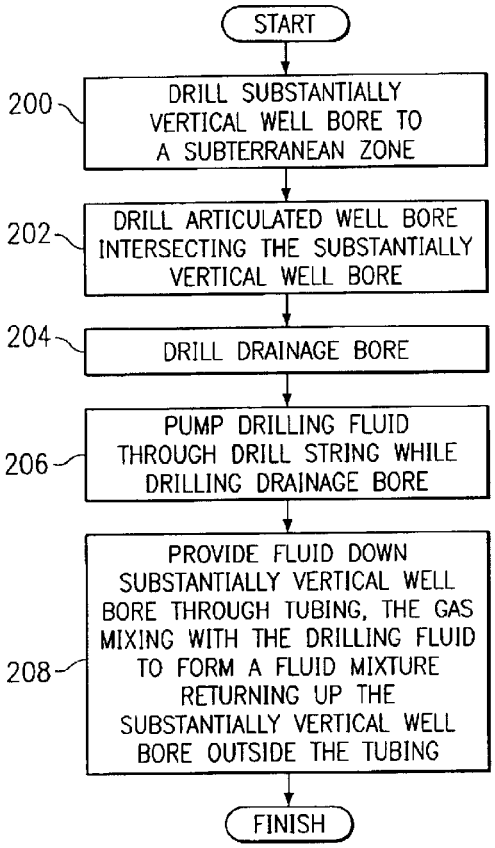
FIG. 4 is a flow chart illustrating an example method for circulating fluid in a well system in which a fluid is provided down a substantially vertical well bore through a tubing, in accordance with an embodiment of the present invention.

FIG. 4 is a flowchart illustrating an example method for circulating fluid in a well system in accordance with an embodiment of the present invention. The method begins at step 200 where a substantially vertical well bore is drilled from a surface to a subterranean zone. In particular embodiments, the subterranean zone may comprise a coal seam or a hydrocarbon reservoir. At step 202 an articulated well bore is drilled from the surface to the subterranean zone. The articulated well bore is drilled using a drill string. The articulated well bore is horizontally offset from the substantially vertical well bore at the surface and intersects the substantially vertical well bore at a junction proximate the subterranean zone. The junction may be at an enlarged cavity.

Step 204 includes drilling a drainage bore from the junction into the subterranean zone. At step 206, a drilling fluid is pumped through the drill string when the drainage bore is being drilled. The drilling fluid may exit the drill string proximate a drill bit of the drill string.

At step 208, gas, such as compressed air, is provided down the substantially vertical well bore through a tubing. In other embodiments, other fluids may be provided down the substantially vertical well bore through the tubing. The tubing includes an opening at the junction such that the gas exits the tubing at the junction. In particular embodiments, the gas mixes with the drilling fluid to form a fluid mixture that returns up the substantially vertical well bore outside of the tubing. The fluid mixture may also include fluid and/or cuttings from the subterranean zone. The flow rate or composition of the gas or other fluid provided down the substantially vertical well bore may be varied to control a bottom hole pressure of the system to achieve a desired drilling condition, such as an over-balanced, under-balanced or balanced drilling condition.

Figure 5:
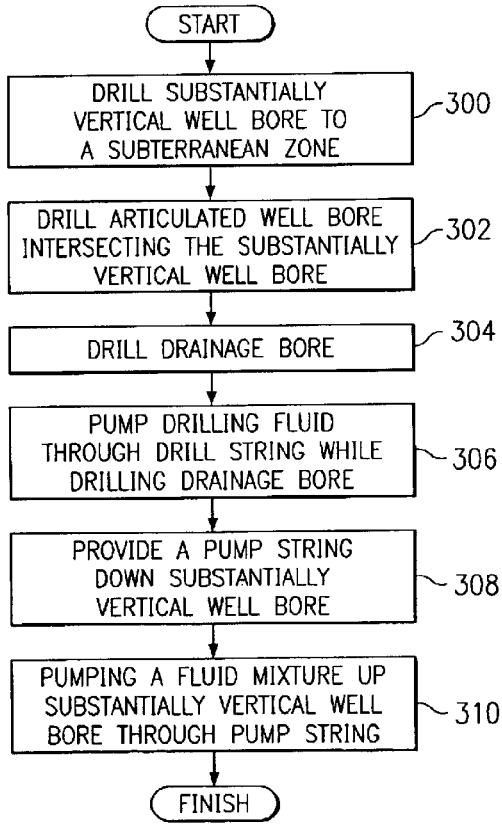
FIG. 5 is a flow chart illustrating an example method for circulating fluid in a well system in which a fluid mixture is pumped up a substantially vertical well bore through a pump string, in accordance with an embodiment of the present invention.

FIG. 5 is a flowchart illustrating an example method for circulating fluid in a well system in accordance with an embodiment of the present invention. The method begins at step 300 where a substantially vertical well bore is drilled from a surface to a subterranean zone. In particular embodiments, the subterranean zone may comprise a coal seam or a hydrocarbon reservoir. At step 302 an articulated well bore is drilled from the surface to the subterranean zone. The articulated well bore is drilled using a drill string. The articulated well bore is horizontally offset from the substantially vertical well bore at the surface and intersects the substantially vertical well bore at a junction proximate the subterranean zone. The junction may be at an enlarged cavity.

Step 304 includes drilling a drainage bore from the junction into the subterranean zone. At step 306, a drilling fluid is pumped through the drill string when the drainage bore is being drilled. The drilling fluid may exit the drill string proximate a drill bit of the drill string. At step 308, a pump string is provided down substantially vertical well bore. The pump string includes a pump inlet proximate the junction. At step 310, a fluid mixture is pumped up substantially vertical well bore through the pump string. The fluid mixture enters the pumps string at the pump inlet. The fluid mixture may comprise the drilling fluid after the drilling fluid exits the drill string, fluid from the subterranean zone and/or cuttings from the subterranean zone. The speed of the pumping of the fluid mixture up the substantially vertical well bore through the pump string may be varied to control a bottom hole pressure to achieve a desired drilling condition, such as an over-balanced, under-balanced or balanced drilling condition.

Although the present invention has been described in detail, various changes and modifications may be suggested to one skilled in the art. It is intended that the present invention encompass such changes and modifications as falling within the scope of the appended claims.

What is claimed is:

1. A method for circulating drilling fluid in a well system, comprising:

drilling a substantially vertical well bore from a surface to a subterranean zone;

drilling an articulated well bore from the surface to the subterranean zone using a drill string, the articulated well bore horizontally offset from the substantially vertical well bore at the surface and intersecting the substantially vertical well bore at a junction proximate the subterranean zone;

drilling a drainage bore from the junction into the subterranean zone;

pumping a drilling fluid through the drill string when drilling the drainage bore, the drilling fluid exiting the drill string proximate a drill bit of the drill string;

providing fluid down the substantially vertical well bore through a tubing, the tubing having an opening at the junction such that the fluid exits the tubing at the junction; and wherein a fluid mixture returns up the substantially vertical well bore outside of the tubing, the fluid mixture comprising the drilling fluid after the drilling fluid exits the drill string.

2. The method of claim 1, wherein providing fluid down the substantially vertical well bore comprises providing gas down the substantially vertical well bore.

3. The method of claim 2, wherein the fluid mixture further comprises at least one of:

the gas provided down the substantially vertical well bore after the gas exits the tubing;

fluid from the subterranean zone; and cuttings from the subterranean zone.

4. The method of claim 1, further comprising regulating the pumping of the drilling fluid through the drill string to form a fluid seal, the fluid seal comprising a level of fluid that resists gas from the subterranean zone from flowing up the articulated well bore.

5. The method of claim 1, further comprising varying a flow rate of the fluid provided down the substantially vertical well bore to control a bottom hole pressure to achieve a desired drilling condition.

6. The method of claim 5, wherein the desired drilling condition is an under-balanced, balanced or over-balanced drilling condition.

7. The method of claim 1, further comprising changing the composition of the fluid provided down the substantially vertical well bore to achieve a desired drilling condition.

8. The method of claim 1, wherein the subterranean zone comprises a coal seam.

9. The method of claim 1, wherein the subterranean zone comprises a hydrocarbon reservoir.

10. The method of claim 1, wherein the fluid provided down the substantially vertical well bore comprises compressed air.

11. A method for circulating drilling fluid in a well system, comprising:

drilling a substantially vertical well bore from a surface to a subterranean zone;

drilling an articulated well bore from the surface to the subterranean zone using a drill string, the articulated well bore horizontally offset from the substantially vertical well bore at the surface and intersecting the substantially vertical well bore at a junction proximate the subterranean zone;

drilling a drainage bore from the junction into the subterranean zone;

pumping a drilling fluid through the drill string when drilling the drainage bore, the drilling fluid exiting the drill swing proximate a drill bit of the drill string;

providing fluid down the substantially vertical well bore outside of a tubing disposed in the substantially vertical well bore, the tubing having an opening at the junction; and wherein a fluid mixture enters the opening of the tubing at the junction and returns up the substantially vertical well bore through the tubing, the fluid mixture comprising the drilling fluid after the drilling fluid exits the drill string.

12. The method of claim 11, wherein providing fluid down the substantially vertical well bore comprises providing gas down the substantially vertical well bore.

13. The method of claim 12, wherein the fluid mixture further comprises at least one of:

the gas provided down the substantially vertical well bore;

fluid from the subterranean zone; and cuttings from the subterranean zone.

14. The method of claim 11, further comprising varying a flow rate of the fluid provided down the substantially vertical well bore to control a bottom hole pressure to achieve a desired drilling condition.

15. The method of claim 14, wherein the desired drilling condition is an under-balanced, balanced or over-balanced drilling condition.

16. The method of claim 11, further comprising changing the composition of the fluid provided down the substantially vertical well bore to achieve a desired drilling condition.

17. The method of claim 11, wherein the subterranean zone comprises a coal seam.

18. The method of claim 11, wherein the subterranean zone comprises a hydrocarbon reservoir.

19. The method of claim 11, wherein the fluid provided down the substantially vertical well bore comprises compressed air.

20. A method for circulating fluid in a well system, comprising:

pumping a first fluid through an articulated well bore, the articulated well bore horizontally offset from a substantially vertical well bore at the surface and intersecting the substantially vertical well bore at a junction proximate a subterranean zone;

providing a second fluid down the substantially vertical well bore through a tubing, the tubing having an opening at the junction such that the second fluid exits the tubing at the junction;

wherein a fluid mixture returns up the substantially vertical well bore outside of the tubing, the fluid mixture comprising the first fluid.

21. The method of claim 20, wherein the first fluid is pumped through the articulated well bore while making connections to a drill string in the articulated well bore.

22. The method of claim 20, wherein the first fluid is pumped through the articulated well bore while tripping a drill string in the articulated well bore.

23. The method of claim 20, wherein providing a second fluid down the substantially vertical well bore comprises providing gas down the substantially vertical well bore.

24. The method of claim 23, wherein the fluid mixture further comprises at least one of:

the gas provided down the substantially vertical well bore after the gas exits the tubing;

fluid from the subterranean zone; and cuttings from the subterranean zone.

25. The method of claim 20, further comprising regulating the pumping of the first fluid through the articulated well bore to form a fluid seal, the fluid seal comprising a level of fluid that resists gas from the subterranean zone from flowing up the articulated well bore.

26. The method of claim 20, further comprising varying a flow rate of the second fluid provided down the substantially vertical well bore to control a bottom hole pressure to achieve a desired drilling condition.

27. The method of claim 26, wherein the desired drilling condition is an under-balanced, balanced or over-balanced drilling condition.

28. The method of claim 20, claim further comprising changing the composition of the second fluid provided down the substantially vertical well bore to achieve a desired drilling condition.

29. The method of claim 20, wherein the subterranean zone comprises a coal seam.

30. The method of claim 20, wherein the subterranean zone comprises a hydrocarbon reservoir.

31. The method of claim 20, wherein the second fluid comprises compressed air.

32. A method for circulating fluid in a well system, comprising:

pumping a first fluid through an articulated well bore, the articulated well bore horizontally offset from a substantially vertical well bore at the surface and intersecting the substantially vertical well bore at a junction proximate a subterranean zone;

providing a second fluid down the substantially vertical well bore outside of a tubing disposed in the substantially vertical well bore, the tubing having an opening at the junction;

wherein a fluid mixture enters the opening of the tubing at the junction and returns up the substantially vertical well bore through the tubing, the fluid mixture comprising the first fluid.

33. The method of claim 32, wherein the first fluid is pumped through the articulated well bore while making connections to a drill string in the articulated well bore.

34. The method of claim 32, wherein the first fluid is pumped through the articulated well bore while tripping a drill string in the articulated well bore.

35. The method of claim 32, wherein providing a second fluid down the substantially vertical well bore comprises providing gas down the substantially vertical well bore.

36. The method of claim 35, wherein the fluid mixture further comprises at least one of:

the gas provided down the substantially vertical well bore;

fluid from the subterranean zone; and cuttings from the subterranean zone.

37. The method of claim 32, further comprising varying a flow rate of the second fluid provided down the substantially vertical well bore to control a bottom hole pressure to achieve a desired drilling condition.

38. The method of claim 37, wherein the desired drilling condition is an under-balanced, balanced or over-balanced drilling condition.

39. The method of claim 32, further comprising changing the composition of the second fluid provided down the substantially vertical well bore to achieve a desired drilling condition.

40. The method of claim 32, wherein the subterranean zone comprises a coal seam.

41. The method of claim 32, wherein the subterranean zone comprises a hydrocarbon reservoir.

42. The method of claim 32, wherein the second fluid comprises compressed air.

43. A method for circulating drilling fluid in a well system, comprising:

drilling a substantially vertical well bore from a surface to a subterranean zone;

drilling an articulated well bore from the surface to the subterranean zone using a drill string, the articulated well bore horizontally offset from the substantially vertical well bore at the surface and intersecting the substantially vertical well bore at a junction proximate the subterranean zone;

drilling a drainage bore from the junction into the subterranean zone;

pumping a drilling fluid through the drill string when drilling the drainage bore, the drilling fluid exiting the drill string proximate a drill bit of the drill string;

providing a pump string down the substantially vertical well bore, the pump string comprising a pump inlet proximate the junction; and pumping a fluid mixture up the substantially vertical well bore through the pump string, the fluid mixture entering the pump string at the pump inlet.

44. The method of claim 43, wherein the fluid mixture comprises at least one of:

the drilling fluid after the drilling fluid exits the drill string;

fluid from the subterranean zone; and cuttings from the subterranean zone.

45. The method of claim 43, further comprising regulating the pumping of the drilling fluid through the drill string to form a fluid seal, the fluid seal comprising a level of fluid that resists gas from the subterranean zone from flowing up the articulated well bore.

46. The method of claim 43, further comprising:

providing a pressure sensor down the substantially vertical well bore; and detecting a pressure of the substantially vertical well bore using the pressure sensor.

47. The method of claim 43, further comprising varying the speed of the pumping of the fluid mixture up the substantially vertical well bore through the pump string to control a bottom hole pressure to achieve a desired drilling condition.

48. The method of claim 47, wherein the desired drilling condition is an under-balanced, balanced or over-balanced drilling condition.

49. The method of claim 43, wherein the subterranean zone comprises a coal seam.

50. The method of claim 43, wherein the subterranean zone comprises a hydrocarbon reservoir.

51. A method for circulating fluid in a well system, comprising:

pumping a fluid through an articulated well bore, the articulated well bore horizontally offset from a substantially vertical well bore at the surface and intersecting the substantially vertical well bore at a junction proximate a subterranean zone;

providing a pump string down the substantially vertical well bore, the pump string comprising a pump inlet proximate the junction; and pumping a fluid mixture up the substantially vertical well bore through the pump string, the fluid mixture entering the pump string at the pump inlet.

52. The method of claim 51, wherein the fluid is pumped through the articulated well bore while making connections to a drill string in the articulated well bore.

53. The method of claim 51, wherein the fluid is pumped through the articulated well bore while tripping a drill string in the articulated well bore.

54. The method of claim 51, wherein the fluid mixture further comprises at least one of:

the fluid pumped through the articulated well bore;

fluid from the subterranean zone; and cuttings from the subterranean zone.

55. The method of claim 51, further comprising regulating the pumping of the fluid through the articulated well bore to form a fluid seal, the fluid seal comprising a level of fluid that resists gas from the subterranean zone from flowing up the articulated well bore.

56. The method of claim 51, further comprising:

providing a pressure sensor down the substantially vertical well bore; and detecting a pressure of the substantially vertical well bore using the pressure sensor.

57. The method of claim 51, further comprising varying the speed of the pumping of the fluid mixture up the substantially vertical well bore through the pump string to control a bottom hole pressure to achieve a desired drilling condition.

58. The method of claim 57, wherein the desired drilling condition is an under-balanced, balanced or over-balanced drilling condition.

59. The method of claim 51, wherein the subterranean zone comprises a coal seam.

60. The method of claim 51, wherein the subterranean zone comprises a hydrocarbon reservoir.

61. A method for circulating drilling fluid in a well system, comprising:

drilling a substantially vertical well bore from a surface to a subterranean zone;

drilling an articulated well bore from the surface to the subterranean zone using a drill string, the articulated well bore horizontally offset from the substantially vertical well bore at the surface and intersecting the substantially vertical well bore at a junction proximate the subterranean zone;

drilling a drainage bore from the junction into the subterranean zone;

pumping a drilling fluid through the drill string when drilling the drainage bore, the drilling fluid exiting the drill string proximate a drill bit of the drill string; and providing fluid to at least one of the well bores to vary a bottom hole pressure of the system.

62. The method of claim 61, wherein the fluid provided to at least one of the well bores comprises compressed air.

63. The method of claim 61, further comprising varying a flow rate of the fluid provided to at least one of the well bores to control the bottom hole pressure.

* * * * *